US006478070B2

(12) United States Patent
Poppema

(10) Patent No.: US 6,478,070 B2
(45) Date of Patent: Nov. 12, 2002

(54) RETRACTABLE FLEXIBLE DOOR METHOD AND APPARATUS

(76) Inventor: John Poppema, 5530 268 Street, Langley BC (CA), V3W 3X4

( * ) Notice: Subject to any disclaimer, the term of this patent is extended or adjusted under 35 U.S.C. 154(b) by 0 days.

(21) Appl. No.: 09/731,538

(22) Filed: Dec. 6, 2000

(65) Prior Publication Data

US 2001/0030028 A1 Oct. 18, 2001

Related U.S. Application Data

(60) Provisional application No. 60/169,203, filed on Dec. 6, 1999, and provisional application No. 60/227,139, filed on Aug. 22, 2000.

(51) Int. Cl.[7] ..... E06B 9/08

(52) U.S. Cl. ..... 160/23.1; 160/31; 160/273.1

(58) Field of Search ..... 160/23.1, 26, 27, 160/28, 31, 98, 99, 100, 271, 273.1, 315, 405

(56) References Cited

U.S. PATENT DOCUMENTS

| | | | | | |
|---|---|---|---|---|---|
| 27,103 | A | | 2/1860 | Burchell | |
| 1,604,054 | A | | 10/1926 | Kuyper | |
| 2,517,514 | A | * | 8/1950 | Walsh | 160/31 |
| 2,560,397 | A | | 7/1951 | Tims | |
| 3,116,097 | A | | 12/1963 | Novales | |
| 4,359,081 | A | * | 11/1982 | Brower | 160/243 |
| 4,651,797 | A | | 3/1987 | Lange | |
| 4,821,786 | A | | 4/1989 | Johnston | |
| 4,825,921 | A | * | 5/1989 | Rigter | 160/23.1 |
| 5,123,474 | A | | 6/1992 | Smith | |
| 5,505,244 | A | | 4/1996 | Thumann | |
| 5,671,790 | A | * | 9/1997 | Andersen et al. | 160/31 X |
| 5,758,704 | A | | 6/1998 | Elrod | |
| 6,003,583 | A | * | 12/1999 | Lacoste et al. | 160/273.1 X |
| 6,082,432 | A | * | 7/2000 | Kissinger | 160/273.1 X |
| 6,267,168 | B1 | * | 7/2001 | Davies et al. | 160/23.1 |

* cited by examiner

*Primary Examiner*—David M. Purol
(74) *Attorney, Agent, or Firm*—Robert B. Hughes; Hughes Law Firm, PLLC

(57) ABSTRACT

A retractable screen apparatus having an upper bracketing component and a lower bracketing component mounted to the upper and lower portions of an opening respectively. Each bracketing component has a connection portion that is connected to upper and lower connection regions of a substantially vertical screen dispenser. A handle attached to the screen of the screen dispenser displaces the screen to a retracted position where the upper and lower laterally extended edges of the screen are contained in slideways in the upper and lower bracketing components. A connection system employing a double threaded screw allows the apparatus to be retrofitted to existing door moldings having a regular shaped surfaces.

23 Claims, 23 Drawing Sheets

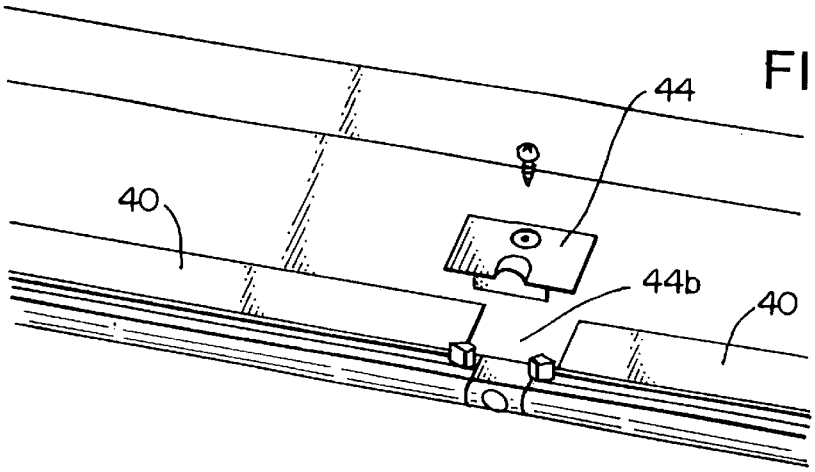
FIG. 50
FIG. 51
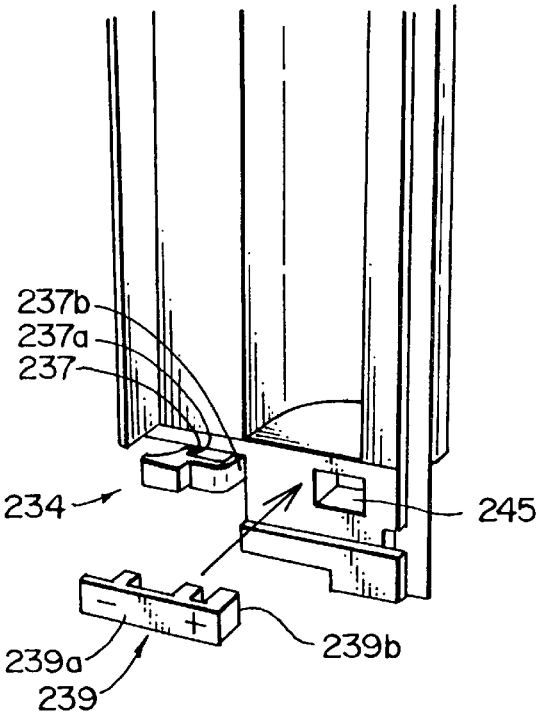
FIG. 52
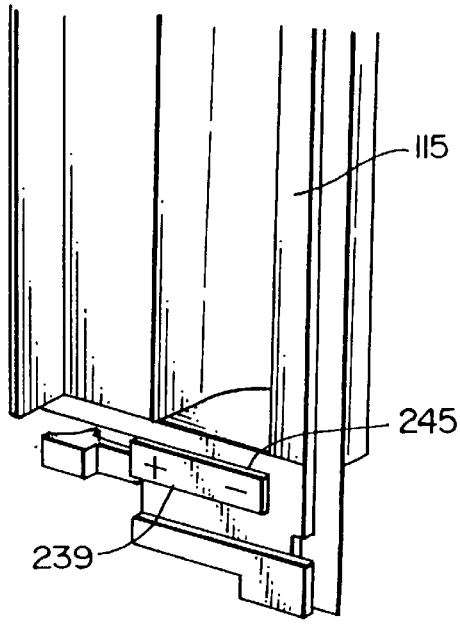

RETRACTABLE FLEXIBLE DOOR METHOD AND APPARATUS

RELATED APPLICATIONS

This application is based upon and claims priority of U.S. Provisional Ser. Nos. 60/169,203 filed Dec. 6, 1999, and 60/227,139 filed Aug. 22, 2000.

FIELD OF THE INVENTION

The present invention relates to flexible extendable screen doors that extend from a retracted position to an open or extracted position. In particular, the present invention candy retrofitted to existing exterior doors that have peripheral moldings with outer surfaces that have nonplanar properties or not aligned in a plane defined by the vertical and lateral axis.

BACKGROUND

During warm weather, homeowners desire to have fresh air enter their houses without the burden of insects or debris from trees and foliage entering their houses. It is common to use screen doors to allow fresh air to enter a household. Prior art screen doors are either inflexible sliding members or flexible extracted versions. The apparatus the present invention relates to flexible extracted type screen doors.

The prior art extractable screen doors are ill-equipped to be retrofitted to many existing moldings of exterior hinged doors. The prior art extractable doors fail to provide bracketing members that provide support and rigidity to the screen. Further, the prior art screen doors lack various features that will be further understood with the detailed description of the preferred embodiment.

BACKGROUND ART

A search of the patent literature has a number of patents directed toward these problems, these being the following:

U.S. Pat. No. 27,103 Burchell, shows a screen system where Roller B is attached to the upper part of the frame. The rods a' are secured to the frame at the stiles b, and tubes c house the rods a'. The lower end of the net C is surrounded by members e and f which appeared to be pieces of wood which are bound together by screws i.

U.S. Pat. No. 1,604,054 Kuyper, shows in FIG. 6 is a sectional view taken at line 6—6 of FIG. 1 where it is seen that tracks 17 house the guide portion 16 which are attached to the screen 13 and the binder 14. FIGS. 4 and 5 shows another mounting method were clipped 22 is formed within the plaster 20 and is adapted to receive the tracks 17 within the sides 23.

U.S. Pat. No. 2,560,397 Tims, shows an awning that has a front oblique panel 9 and side panels 10. The spring roller 18 holds the shade 17. As seen in FIG. 2, the bolt court 21 extends around central pole 22 to allow the shade 17 to be withdrawn an upright position.

U.S. Pat. No. 3,116,097 Novales, shows a curtain assembly where the guides 28 pivot 90 degrees to opposition shown in FIG. 3 so they can roll up as seen in FIG. 2. You can see in FIG. 2 that the parallel members 18 can only be mounted to a flat window frame 10.

U.S. Pat. No. 4,651,797 Lange, has a screen system which is the seen in FIG. 3. The screen is extracted from the housing 4. As seen in FIG. 2, the screen is latched by anchoring pin 32.

U.S. Pat. No. 4,821,786 Johnston discloses a slidable screen door system that is best seen in FIG. 6. Apparently, wheels 24 glide along the track 23 in the track hangar 22. As seen in FIG. 3, the boxlike enclosure 17 is mounted on the jam 12. There is disclosure of how this would be mounted upon a non flat surface.

U.S. Pat. No. 5,505,244 Thumann, shows a retractable covering for a door that is mounted to the side of a door. As seen in FIGS. 3 and 4, the housing 24 is attached to the first molding 18 and the rigid side member 100 is withdrawn an attached to the V-shaped groove 120 of the latching strip 114.

U.S. Pat. No. 5,758,704 Elrod, shows a roll up screen door which is secured in place by number of threaded high fasteners 18.

It will become apparent in the discussion below that the apparatus of the present invention has numerous improvements over the prior art designs. Namely, the prior art fails to disclose a system that can be retrofitted to doorframes with various outer surfaces of the moldings.

SUMMARY OF THE INVENTION

The present invention comprises a retractable screen system adapted to be mounted to an opening defining structure, such a doorway or window structure, where the opening defining structure comprises upper and lower structure members and first and second side structure members.

The system comprises upper and lower bracketing members adapted to be mounted to the opening structure at upper and lower locations adjacent to the upper and lower structure members.

The system also comprises a generally vertically aligned screen retaining and dispensing assembly adapted to be mounted at a side mounting location adjacent to said first side structure member. The two bracketing members and the screen retaining and dispensing assembly can collectively be considered to constitute a perimeter frame extending around a substantial portion of the opening of the opening defining structure, when the retractable screen system is in place.

Each of the bracketing members has a lateral axis and further comprises a connecting portion and a slideway portion. The connecting portion connects the bracketing member to the opening defining structure, while the slideway portion defines a laterally aligned slideway.

The retaining and dispensing assembly comprises a screen housing, and also a screen member having inner and outer vertically aligned screen edge portions and upper and lower horizontally aligned screen edge portions.

The retaining and dispensing assembly also comprises a dispensing and retaining mechanism mounted to the housing and having a rotatable portion connected to the screen inner edge portion. This dispensing and retracting mechanism is arranged to be able to retain the screen member in a rolled up retained position and enable the screen member to be extended from the retained position to its extended positions.

The slideway portions of the upper and lower bracketing members are arranged to engage the upper and lower screen edge portions, respectively, in retaining engagement. The slideways are aligned relative to the retaining and dispensing assembly so that the upper and lower screen edge portions can be extended and retracted from the retaining and dispensing assembly along the slideways of the upper and lower bracketing members to the extended position and then retracted from the extended position along the slideways to the retracted position.

The retaining and dispensing assembly comprises a screen housing connecting portion which is fixedly connected to the opening defining structure and a detachable screen housing portion which is revocably mounted to the screen housing connecting portion. Thus, the detachable screen housing portion, along with the screen member and the dispensing and retracting mechanism, can be removed as a unit from the screen housing connecting portion, and also be reconnected to said screen housing connecting portion. This enables the screen member along with its associated components to be removed and replaced into the system for various purposes, such as repair or replacement of the screen member.

In a preferred form, the detachable screen housing portion has first and second connecting regions. The first connecting region is adjacent to a location at which the screen member extends from the screen housing, and the second connecting region is spaced laterally from the first connecting region. Thus, the detachable screen housing portion can be mounted to the fixed connecting portion by first engaging the first connecting region to the fixed connecting portion to properly position the screen member, and then the second connecting region can be connected.

The screen housing further comprises upper and lower end caps, at which the first and second connecting regions are positioned, by which connection is made to the dispensing and retracting mechanism.

Also, the dispensing and retracting mechanism comprises a retracting spring member having a first connecting end connected to the rotatable portion of the dispensing and retracting mechanism, and a second connecting end, which is connected to an adjusting member which can be moved to selective positions so as to either relax the spring member or create increased stress on the spring member. Thus it is able to adjust a tension force on the screen member.

In a preferred form, the connecting member has a protruding connecting portion which extends into an end of the first and second slideway portions so as to come into engagement with matching connecting portions of the first and second slideway portions.

Each slideway portion of the first and second bracketing members defines a related elongate slot of a first width dimension, and having a slideway chamber communicating with the slot and having a lateral dimension greater than the width dimension of its related slot. Each of the upper and lower edge portions of the screen have connected thereto spaced connecting members having thickness dimensions greater than the first width dimension of its related slot, but able to be positioned within the related slot chamber. Thus the connecting members are positioned within the slot chamber and the screen member extends through the slot, so that the edge portions of the screen are retained in the upper and lower slideways.

Each of the connecting members has a first connecting portion of a first hardness level, and a second laterally yielding connecting portion, and further has a width dimension of the connecting member at the location of the yielding portion greater than the width dimension of its related slot. The connecting portions are arranged so that with a force being imposed on the screen member so as to tend to pull the screen edge portion out of its related slot, the yielding portion of the connecting member is able to be compressed to permit the connecting member to move through the slot. Thus a problem of impact on the screen member causing damage to the screen member is at least alleviated by the connecting portions being released upon encountering the impact force.

In a preferred form, each of the connecting members comprises, prior to being connected to its related screen member a plurality of connecting fingers extending outwardly from the connecting member. The fingers provide connections by the connecting fingers being deformed from their original extending position to make a connection through the screen member. In a preferred form, the fingers of the connecting member are made of thermally deformable material. Thus, after the connecting members are positioned relative to the screen member so that the fingers extend through the screen member, heat can be applied to the fingers to cause deformation of the fingers and connection to the screen member.

Also, the spacing of the connecting members along the length of the upper and lower screen edge portions is such, relative to the positioning of the connecting members with the screen member in its retracted position, so that most of the connecting members are out of radial alignment with one another. Thus, the screen member in its rolled up retained position occupies less space.

Also, the outer edge portion of the screen member has at upper and lower locations connecting members to retain the screen member in its extended position, and the end connecting members of the upper and lower bracketing members have laterally extending connecting portions which are positioned so as to come into releasable connecting engagement with the connecting members on the screen member.

At least one of the upper bracketing member, lower bracketing member and the screen housing has a mounting portion which provides for connection to the opening defining structure. The system further comprises one or more connectors adapted to connect the mounting portion to the opening defining structure in a manner that the mounting portion could have one or more portions spaced from the opening defining structure so as to properly align the mounting structure. Each connector comprises a screw member having a head and a shank, with the shank having an outer end threaded portion of a smaller diameter further from the head and an inner threaded shank portion of a greater diameter positioned closer to the head. The screw member is positioned so that the outer threaded end portion is threaded into engagement with the opening defining structure to a predetermined depth, and the inner larger diameter threaded portion is engaged with the mounting structure at a location on the threaded member so that the mounting member is properly positioned. Thus, proper angular alignment can be obtained, and the system of the present invention is able to be mounted to an opening defining structure having various alignments and surface arrangements thereon.

In the preferred form, there is a plurality of such connecting members connecting the mounting structure to the opening defining structure.

The present invention is a retractable flexible screen system adapted to be fitted to a door frame that has lateral sections and upper and lower sections. The retractable flexible screen system comprises a housing that has an upper and lower portion. The housing has a first connection portion located in the lower portion of the housing and a second connection portion that has a surface defining a substantially circular open region that is adapted to engage first threaded portion of an attachment screw. The first threaded portion is located on the head portion of the screw. The shaft portion of the attachment screw has a second threaded portion having a smaller circumference which freely passes through the second connection portion of the housing. The housing further has a third connection portion located in the upper portion of the housing. The interior surface of the housing defines at least a partial interior chamber.

The apparatus further comprises a lower bracket that has a laterally extending mounting region adapted to be rigidly mounted to the lower sill of the doorframe. The lower bracket further has a surface defining a laterally extending gap or slideway and a mounting region that is adapted to be mounted to the first connection portion of the housing. Finally, the lower bracket has an inner surface that defines a chamber.

The apparatus further has an upper bracket having a connection portion that is adapted to be rigidly managed to the upper portion of the doorframe. A longitudinally extending surface defines a laterally extending gap. The upper bracket has a mounting region adapted to be mounted to the third connection portion of the housing. And inner surface located in the upper bracket defines a chamber.

The apparatus further has a retractable screen having an upper portion and lower portion. The screen further has a connection portion and a lateral portion where a substantially vertical brace is attached thereto and the connection portion is attached to a substantially vertical roll. The substantially vertical roll is comprises a spring bias seen system adapted to retract the retractable screen. The upper portion of the screen is adapted to extend in the chamber of the upper mounting bracket and the lower portion of the screen is adapted to extend in the chamber of the lower bracket. The substantially vertical brace is adapted to be displaced laterally in the screen withdrawn from the housing.

The lower mounting bracket has an outer casing rigidly attached to a laterally extending mounting region and has an interior surface adapted to house and inner elongate member having a surface that at least partially defines a cylinder and is adapted to rotate about a substantially lateral axis. The inner elongate member has a surface defining the laterally extending gap of the lower bracket.

The housing comprises a first member fixedly attached to the molding of the doorframe and a second member is adapted to the attached thereto.

The lower portion of the screen has a plurality of buttons that extend in the forward direction a distance that is slightly greater than the forward gap distance of the laterally extending gap of the lower bracket. The buttons are adapted to pass through the laterally extending gap or slideway when excessive tension is applied to the screen.

A dual threaded screw is employed to mounting a vertical brace to a door molding where the threads on the shaft portion of the screw have an outside diameter that is smaller than the engagement surface. Further, the threaded head portion of the screw has an outside diameter greater than the shaft portion and the head portion is adapted to frictionaly engage an engagement surface.

BRIEF DESCRIPTION OF THE DRAWINGS

FIG. 50 shows a central cover case that is adapted to the mounted to the central portion of the lower bracketing component sets;

FIG. 51 is an oblique view of the connector;

FIG. 52 is oblique view of the connector with the component positioned in an enhanced locking position.

DETAILED DESCRIPTION OF THE PREFERRED EMBODIMENT

Throughout this description reference is made to top and bottom, front and rear. The apparatus of the present invention can, and will in practice, be in numerous positions and orientations. These orientation terms, such as top and bottom, are obviously used for aiding the description and are not intended to limit the invention to any specific orientation. Specifically, the apparatus 20 can be mounted to either the left or right side of a door opening there for the screen dispenser 26 will be employed with the racheting region 188 at either the upper or lower locations.

In the following text, there will first be a description of the overall operations of the apparatus of the present invention followed by a detailed description of the preferred embodiment of the present invention.

Figure 1:
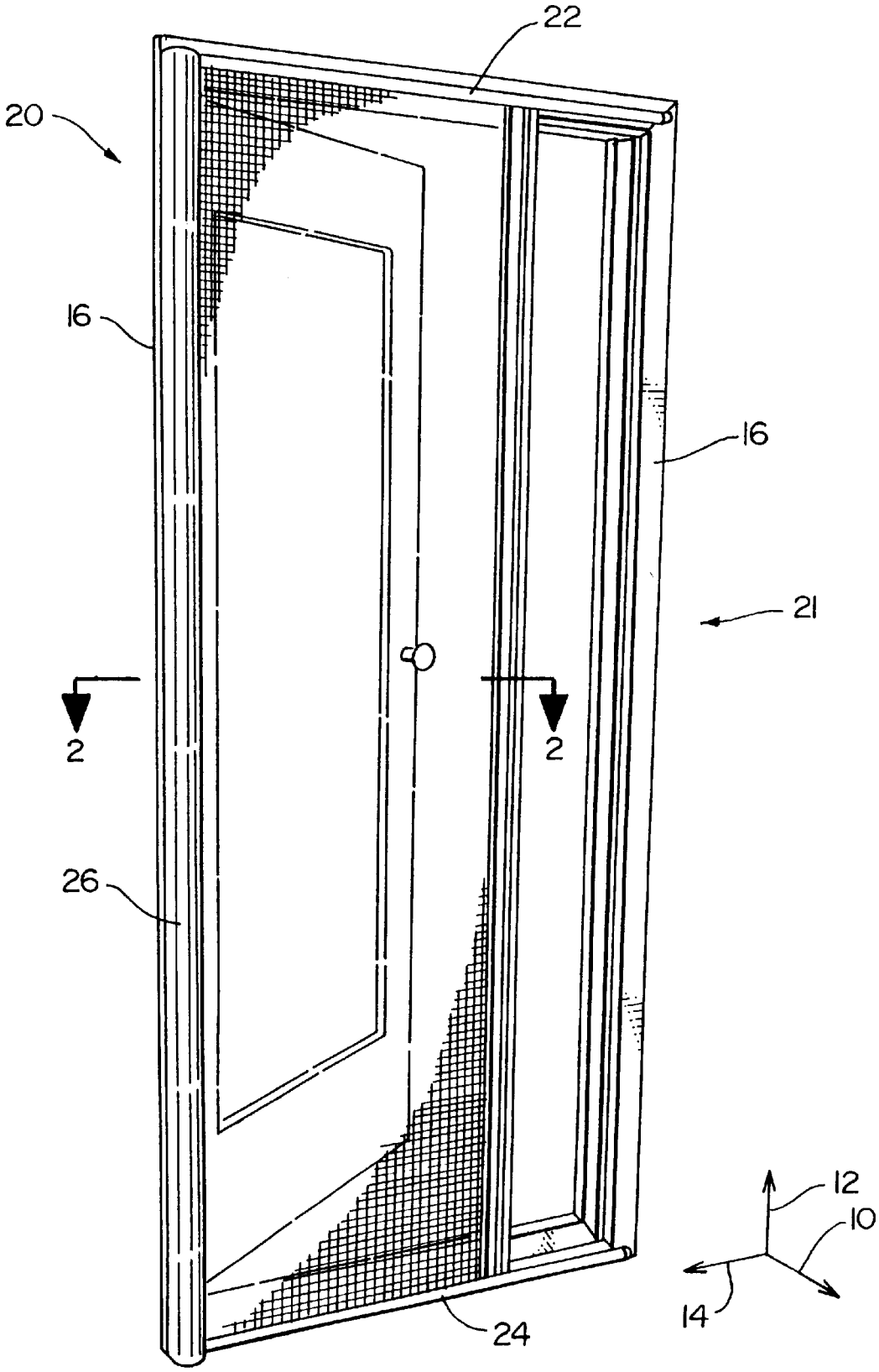
FIG. 1 is an isometric view of the apparatus mounted to a door molding and sill.

To aid the description orthogonal directions are defined shown in FIG. 1, where axis 10 indicates a transverse direction, axis 12 indicates a vertical direction, and axis 14 indicates the lateral direction. The direction of the arrow in axis 10 is referred to as an "outward" direction on the transverse axis with a diametrically opposed direction is herein referred to as the "rearward" direction.

The apparatus of the present invention is a slidable door system that can be mounted to any number of doorframes and exterior sills. The apparatus is particularly advantageous for screen doors.

The apparatus 20 of the present invention is a retractable screen assembly (designated 20) which in turn comprises a perimeter mounting frame or housing 81, and a retractable screen 22 which, as its name suggests, has a retracted position where it is rolled up and located within a portion of the perimeter frame 21, and an extended position where it has been pulled outwardly from the frame and extends across the open area within the perimeter of the mounting frame 81. In the preferred embodiment shown herein, the retractable screen assembly 20 is shown as a retractable screen assembly for a doorway. However, it is to be understood that the basic design of the present invention could be used in other applications, such as providing a retractable screen assembly for a window, and different types of doorways or other access openings for homes, buildings, etc.

The perimeter mounting frame 21 in turn comprises upper and lower laterally aligned bracketing components 22 and 24 located at the upper and lower locations, respectively, of the doorway or other opening, and a substantially vertical screen retaining and dispensing component 26 (hereinafter called the "screen dispensing component" mounted at one side of the doorway).

The main function of the screen retaining and dispensing component 26 is to contain the screen in a rolled up retracted position and enable the screen to be extended therefrom, and the main function of the upper and lower bracketing components 22 and 24 is to provide upper and lower slideways along which the upper and lower edge portions of the screen member 22 can be guided as the screen member 22 moves between its retracted position and its extended position, and also to retain the screen member 22 in its extended position.

This apparatus 20 has a number of desirable features. First, the manner in which the perimeter mounting frame 87 is mounted to a surrounding door structure or other opening structure is such that these components of the perimeter mounting frame 21 (i.e. the bracketing members 22 and 24 the screen dispersion component 26) can be mounted in proper alignment, and angular orientation, regardless of the precise configuration of the door structure (e.g. where the forwardly facing surfaces of the doorway are irregular and/or angularly slanted from the plane of the doorway).

Further, the overall design of the apparatus 20 is such that it can be adapted to fit doorways of different lateral dimensions. More particularly, the upper and lower bracket components 22 and 24 are arranged in this design so that one end of each component 22 and 24 is connected to upper and lower ends of the screen retaining component or member 26, respectively, and the opposite second end can cut to the proper dimension to fit the doorway, this being done in a manner so that this does not in any way impede the proper function of these upper and lower brackets 22 and 24 from being properly mounted and also properly forming their function as a slideway and positioning member for the screen 118.

Further, this apparatus 20 is designed so that the screen member 118, along with the associated mounting components, is able to be easily removed for repair or replacement of the screen itself and also be easily remounted in the apparatus 20. Further, the screen member 22 is engaged in the upper and lower brackets 22 and 24 in a manner that it is releasable from the structure to which it is mounted to alleviate the effect of an impact which might otherwise damage the screen, and also enables the screen to be reattached.

Another advantage is that the main components of the apparatus 20 can be preassembled so that the entire assembly can be shipped in a kit and easily assembled at the installation site. Also, the components are arranged so that the apparatus 20 can be mounted to the doorway opening regardless of whether the hinges of the door are mounted to the left or right side of the door opening.

While the method of the installation will be described more fully later herein, by way of introduction, this can be described briefly in these introductory comments.

When the preassembled components of the apparatus 20 arrive at the installation location, the upper and lower bracket members 22 and 24 are positioned in the doorway (or other opening, such as a window opening) and then one end of each of the brackets 22 and 24 is cut off at a right angle to the proper length, this being easily accomplished by the home "do-it-yourself person" or other person with a saw.

Then the lower bracket 24 is screwed into place, after which the vertical screen dispensing member 26 is connected to the connecting end of the lower bracket 24 and also connected to a vertical structure portion of the door frame. After that, the top bracketing member 23 is secured by screws to the upper structure at the upper part of the door opening and also is connected to the upper end of the screen dispensing member 26.

These steps are accomplished so that with these components in place, the screen member 22 can be selectively pulled outwardly to its extended position and secured in place, and then be retraced by the screen dispensing member 26. Further, a screen containing a housing component of the screen member 22 (to be described more completely later herein) can readily be removed from its installed position (with the screen member 22 retained therein in its rolled up position) for repair or replacement of the screen.

Figure 39:
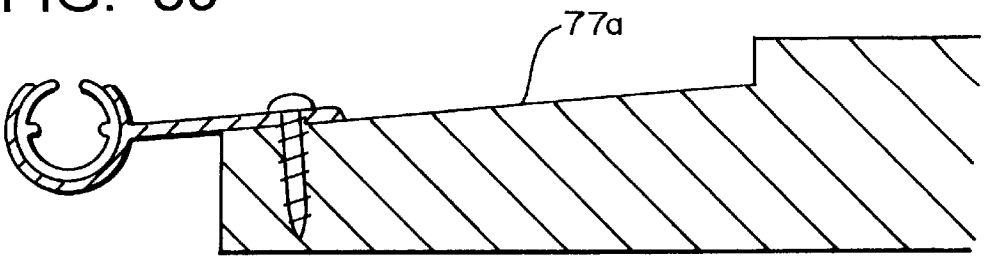
FIG. 39 is a sectional view of the lower bracketing component mounted to a sill with an outward transverse slope.
Figure 40:
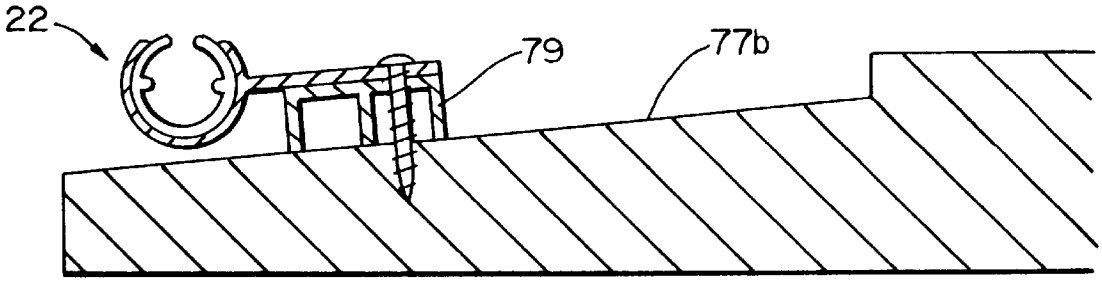
FIG. 40 is a vertical sectional view of the lower bracketing component mounted to a sill where a locking is employed to vertically raise the lower bracketing component.
Figure 41:
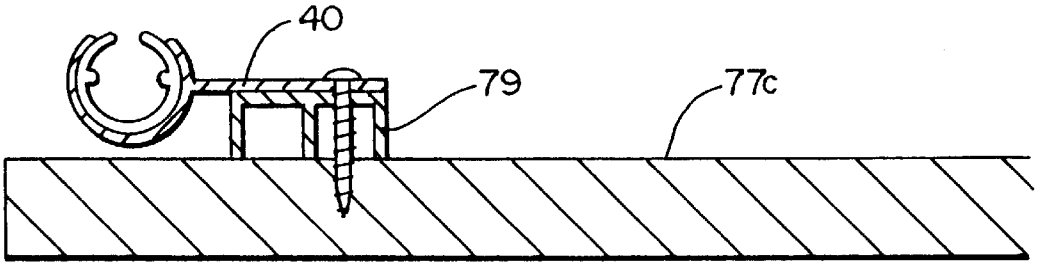
FIG. 41 is a vertical sectional view of the lower bracketing component mounted to a flat sill such as that is found to a door near a garage is employed to vertically raise the lower bracketing component.

In general the installation of the apparatus consists of first inspecting the parameter surface of a door frame to determine if there are any over intrusive transversely extending portions that would affect the positioning of the components of the apparatus 20. At this point the installer will approximate the location of a screen extension plane (the approximate plane of the screen 118) and the bracketing plane (the plane defined by the laterally extending centerpoints 334 and 34 of the upper and lower bracketing members 24 and 22) which is parallel to the screen extension plane. The user can position the upper and lower bracketing members 22 and 24 and the screen dispenser 26 in proximity to final fixed locations to determine a rough location of the bracketing plane which is defined by the components. The user first installs the lower bracketing member or component 22 to the sill of the door frame. As seen in FIGS. 39–41, there are a variety of methods and configurations that the lower bracketing member 22 can be fixed to the sill. Next, the user will mount the vertical brace 86 of the screen dispenser system 26 to a vertical portion of a mold of the door frame. Next the installer will drill holes in the mold that corresponds to the location of one or more engagement surfaces 308(see FIG. 13). In general, the installer ensures that the vertical brace 86 is substantially vertical and maintains the vertical brace in this "alignment position" and the double threaded screw 386 extends through the opening 310 until the threaded head portion 406 freshly engages the locking surface 308. Double threaded screws 384 can be employed with additional corresponding locking surfaces.

Figure 21:
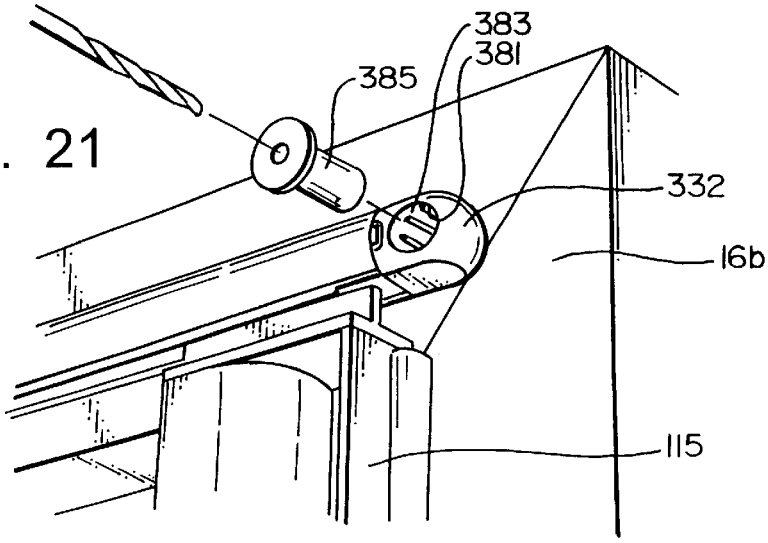
FIG. 21 shows the upper bracketing component being mounted to the molding using a spacing element to drill a hole therethrough the open region.

Next, the upper bracketing component is mounted to the first mounting region 262. The handle 115 is then withdrawn to an open position as shown in FIG. 21, And a second double headed screw passes through an open region 383. The upper bracketing component 24 is held vertically above the lower bracketing component 22 in an alignment position. When the head portion 390 engages the locking surface 381, the upper bracketing member is fixedly mounted to the sill 16. Thereafter, a second double threaded screw can be used to mount the lower bracketing member in a similar fashion.

Thereafter, the handle 115 can be withdrawn from a retracted position to an open position where the and a locking system 201 maintains the handle 115 and a retracted position resisting the force exerted upon screen 118 exerted by the screen retraction system 120.

There will now be a detailed description of the elements of the apparatus 20. As seen in FIG. 1, the apparatus 20 comprises a lower bracketing component 22, an upper bracketing component 24, a substantially vertical screen dispenser 26, and a connector system.

Figure 4:
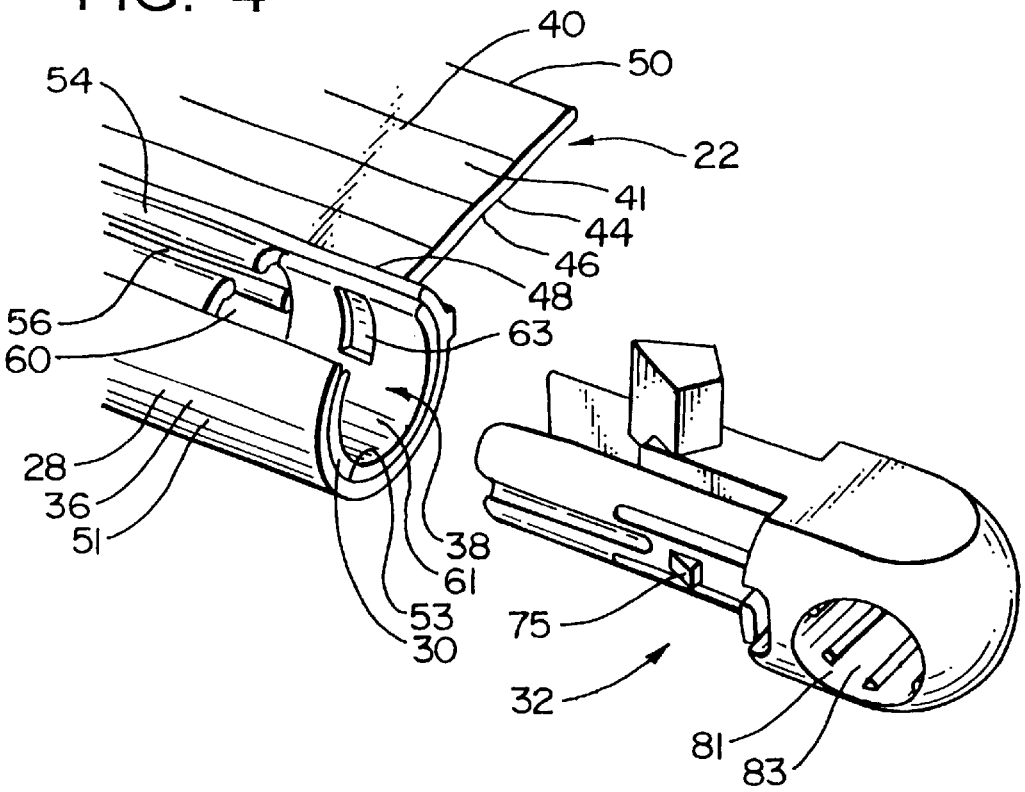
FIG. 4 is isometric view of the lower bracketing component with the end piece adapted to the mounted in the retention piece of the lower bracketing component.
Figure 5:
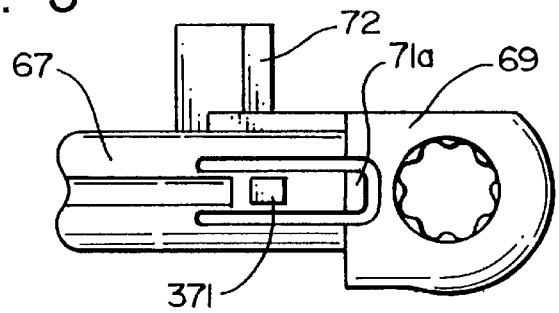
FIG. 5 is a side view of the end piece of the lower or upper bracketing components.
Figure 6:
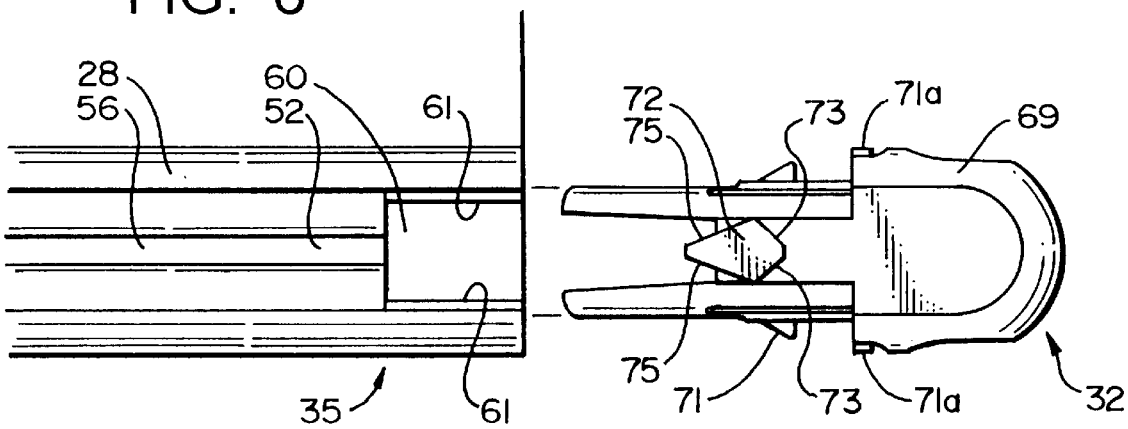
FIG. 6 is a top view of an end piece and a mounting region of the lower bracketing component.

As seen in FIG. 4, the lower bracketing assembly 22 comprises an outer elongation member 28, an inner elongate member 30, and an end piece 32. The outer elongation member 28 comprises a cylindrical member 36 that has a center 38, and a base extension 40. The base extension 40 has an upper portion 41 with an upper surface 42 thereon, a lower portion 44 having a lower contact surface 46 thereon, an inner portion 48 and an outer portion 50 which is rigidly attached to the cylindrical member 36. The cylindrical member 36 has an outer surface 51 which defines a longitudinal gap or slideway 52 which has a function that will further be described herein, and an inner surface 53 which defines at least a partial cylindrical shape that runs substantially in the lateral axis and has the center 38. The inner elongate member 30 is cylindrical in shape and also has a center 38 which is concentric with the cylindrical member 36. The inner elongate member 30 further has an outer surface 54 which defines the gap or slideway 56, and an inner surface 58 that defines an inner chamber 60. Inner surface defines laterally extending extensions 59 that are discussed further herein. As seen in FIG. 6, the gap or slideway 56 has a laterally extending center 62. A substantial a vertical plane 64 shown in FIG. 9 passes through point 62 and point 34 of the inner elongate member 30. The laterally extending center 62 defines the lower portion of a bracketing plane 119. In operation, the bracketing plane 119 is an alignment with the plane defined by screen 118.

Figure 3:
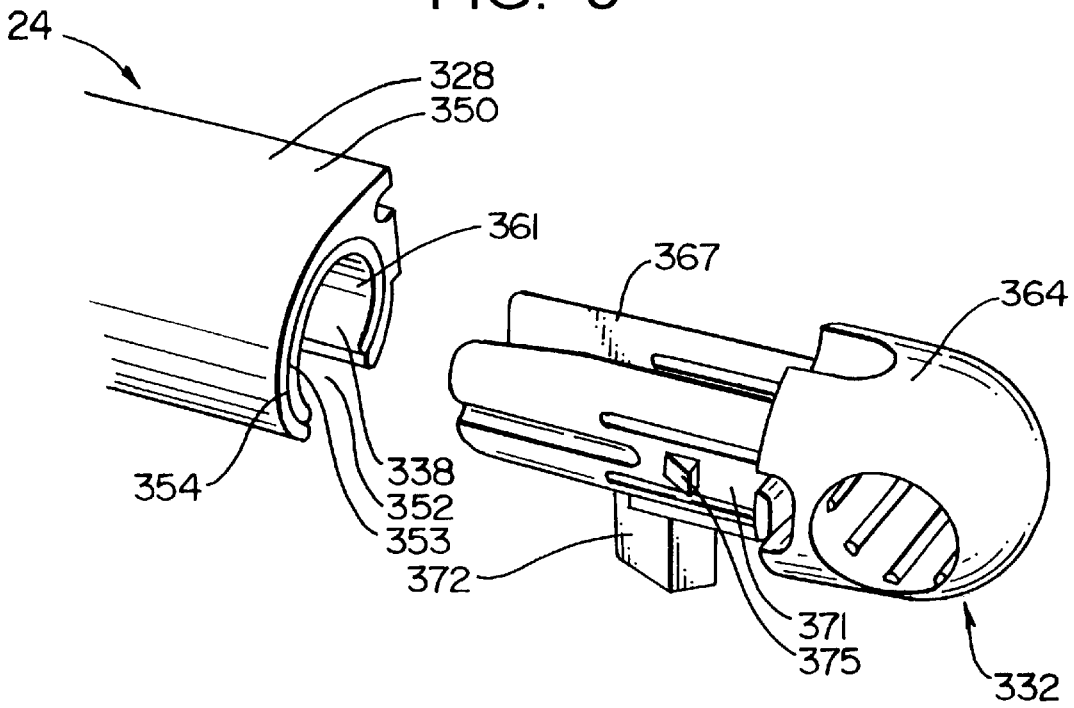
FIG. 3 is an isometric view of the upper bracketing component with the end piece that is adapted to the mounted therein.

Best seen in FIGS. 3–4, located at the end portions of the upper and lower bracketing members 22 and 24 are retention pieces 61. The primary function of the retention pieces are to keep the inner elongate member 30 housed therein and not displaced laterally with respects to the outer elongate member 28. As seen in FIGS. 3 and 4, the retention pieces 61 comprise a recessed region 63 adapted to receive the notches assembly 75 of the end piece 32 discussed further herein below. The retention piece 61 further has an extension 65 adapted to be received by a hole located in the laterally lower an upper extreme portions of the lower an upper bracketing members 24 and 22. The recessed region 65 of the retention piece 61 extend in a vertical arc to allow the notch members to rotate about the lateral axis.

Figure 11A:
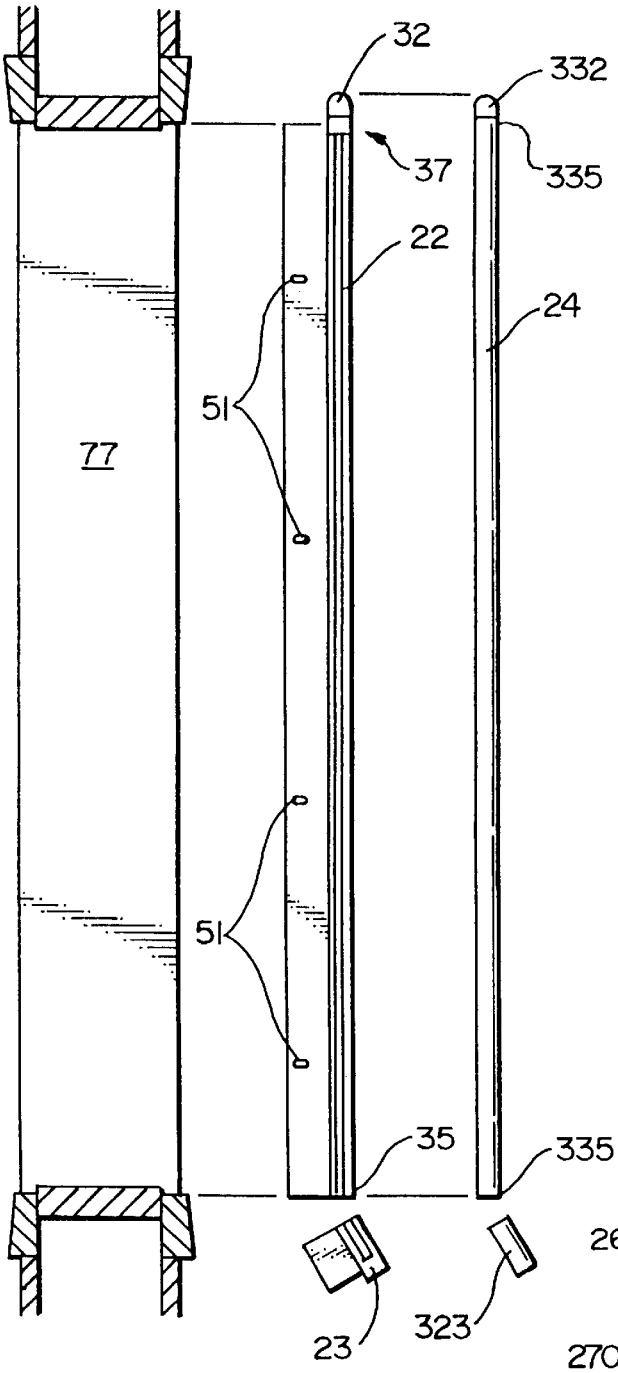
FIG. 11*a* is a horizontal sectional view of a door frame showing the upper and lower bracketing components where the end portions are removed to fit the door sill.
Figure 11B:
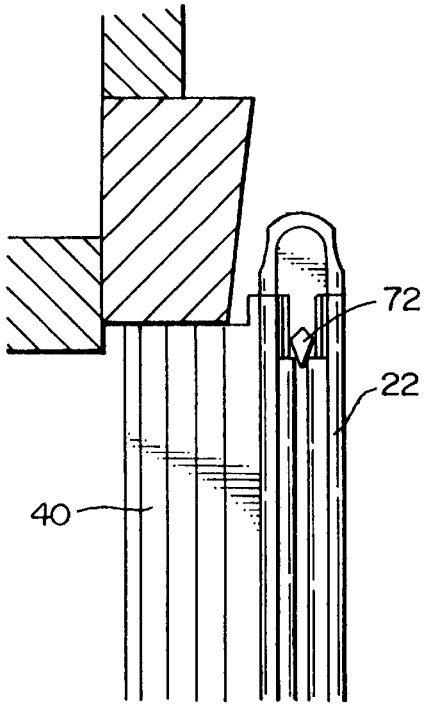
FIG. 11*b* is a top partial sectional view of a molding showing the lower bracketing member fit thereinbetween.

As discussed further herein below, the preferred method of installation requires cutting off one end of the upper and lower bracketing members 22 and 24 thus removing one of the retention pieces 61 from the final installation as shown in FIG. 11.

As seen in FIGS. 3–4, the end piece 32 comprises a shaft portion 67 and a head portion 69. The shaft portion 67 comprises a locking mechanism 71 and a vertically extending member 72. The shaft portion is adapted to be inserted into the inner elongate member 30. The locking mechanism 71 comprises a notch assembly 75 that are adapted to engage the recessed region 63 of the retention pieces 61 of the inner elongate member 30. The end piece 32 is inserted into the inner elongate member 30 and tab portions are depressed inwardly to displace the notches of the notch assembly 75 inwardly to engage the recessed regions 63. Thereafter, the end piece 32 will rotate in the lateral direction in conjunction with the inner elongate member 30.

The head portion 69 comprises a locking surface 81 that defines an open region 83. The locking surface 81 is described further herein relating to the mounting system 27.

As shown in FIG. 4, a similar end piece 332 is used for the upper bracketing component 24. In the preferred form the end pieces 32 for the lower and upper bracketing components 22 and 24 are identical and can be interchangeable used for both components.

There will now be a discussion of the operations and functions of the lower bracketing component 22. As mentioned previously, the outer surface 54 defines a cylinder that extends substantially in the lateral direction, and the surface 54 intimately engages the inner surface 53 of the cylindrical member 36. The radially compressive forces between surface 53 and surface 54 and the coefficient of friction therebetween are sufficiently low so the inner elongate member can rotate about the transverse axis with respect to the elongate member 36. The gap 52 is slightly larger in the transverse direction then slideway 56 of the inner elongate member 30. The reason for this slight increase in size for gap 52 is most easily described with reference to FIGS. 39–41. As seen in these figures, the sill is at various angles with respect to the horizon in the transverse direction. FIG. 39 shows a sill 77*a* that is at a slight incline in the transverse direction. FIG. 40 shows an installation where the lower bracketing assembly 22 is moved reward link and a base 79 is employed. FIG. 41 illustrates the lower bracketing assembly 22 being installed on a flat sill 77*c* with the block 79 providing a support for the extension 40.

Each one of the sills 77 represents various possible configurations of doors that the apparatus of the present invention can retroactively be mounted on. Instead of having to use a specifically manufactured bracket to accommodate the angle of surface 77*a*, the lower bracket 24 will adapt to this surface with almost no intervention from the installer because the inner elongate member 30 will rotate clockwise or counterclockwise so the substantially vertical plane 64 is in the defined bracketing plane. If this same lower bracketing member 24 was installed in the sill 77*c* of FIG. 41, the sill surface 77*c* is now five degrees off from the horizontal plane where the surface 77*c* descends in the outwardly transverse direction. To have the substantially vertical plane 64 lie in the bracketing plane, the inner elongate member 30 will rotate slightly clockwise with respect to the outer elongate member 36. As further discussed herein, the center axis 34 defines the substantially lateral axis of the bracketing plane.

To summarize briefly the functioning of the end piece 32, the shaft portion 67 has at its outer end the two axially extending grooves which interfit in tongue and groove relationship with the two axially aligned elongate protrusions or ridges within the inner member 30 so that the inner member 30 and the end member 32 are rotatably fixed to one another. Further, when the spring loaded notch member 76 which become positioned in the arcuately extending slots in the outer member, so that the end piece is permitted to rotate angularly with respect to the outer member, but is retained axially in the outer member.

There will now be a discussion of the substantially vertical screen dispenser 26 which comprises a screen dispenser 84 and a vertical brace 86.

Figure 2:
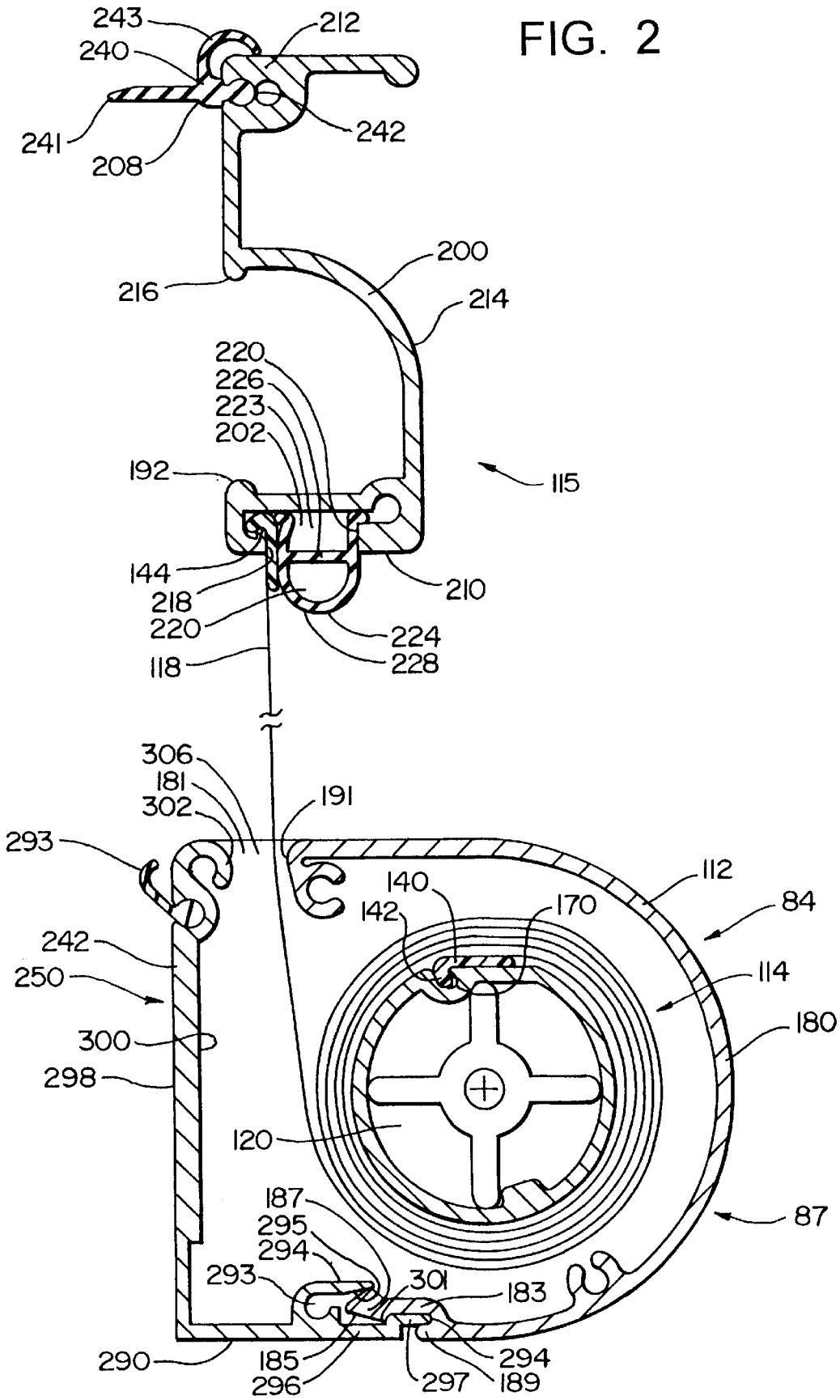
FIG. 2 is a vertical cross-sectional view taken at line 2—2 of FIG. 1 shown in a cross-sectional view of the substantially vertical screen dispenser.

As shown in FIG. 2, the screen dispenser 84 comprises an outer shell 112, a spring-loaded screen extension system 114, and a handle assembly (or handle)115. The screen extension system 114 comprises a screen 118 and a screen retraction system 120.

Figure 32:
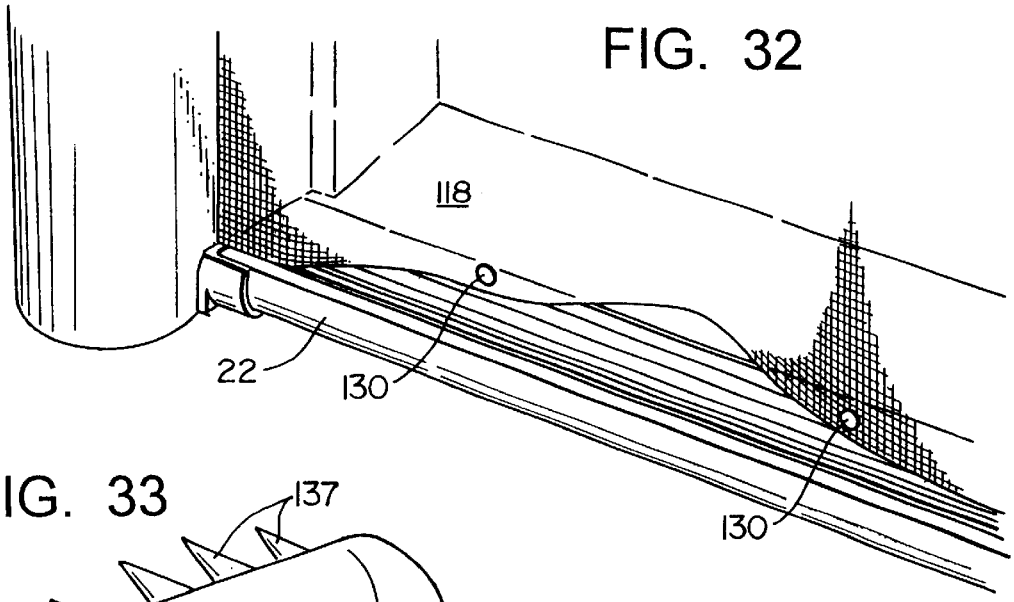
FIG. 32 is isometric view of the lower bracketing component illustrating the breakaway system of the screen where the buttons are withdrawn from the chamber of the lower bracketing component.
Figure 33:
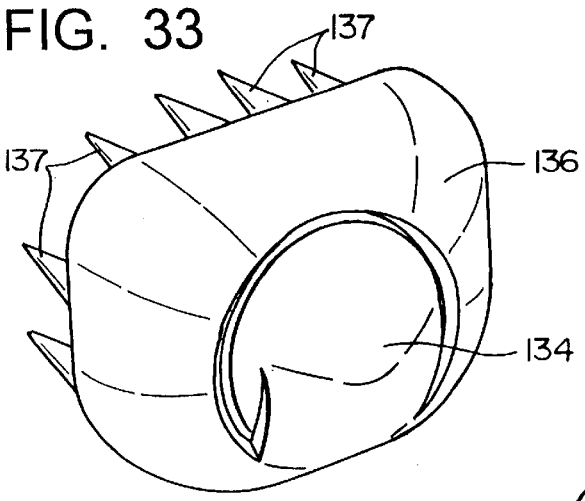
FIG. 33 is an isometric view of a button that is adapted to be mounted to the upper and lower laterally extending peripheral regions of the screen.
Figure 34:
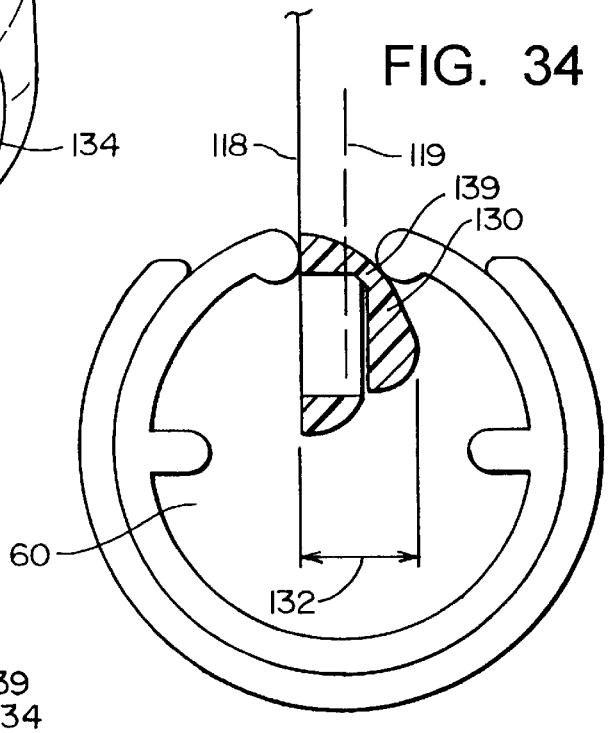
FIG. 34 is a cross-sectional view of a bracketing component showing the button housed in chamber 60.
Figure 35:
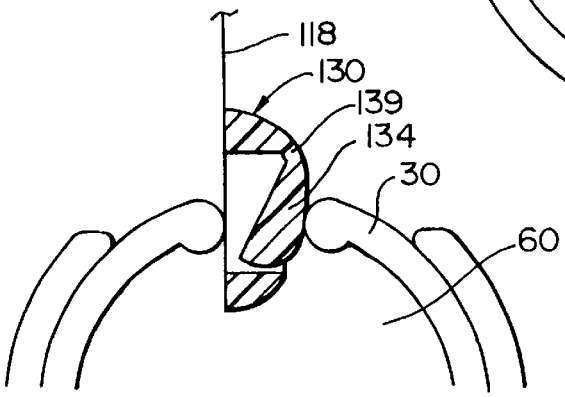
FIG. 35 illustrates the flexibility of the central region of the button and how the button is withdrawn from the bracketing component when tension is placed upon the screen.
Figure 36:
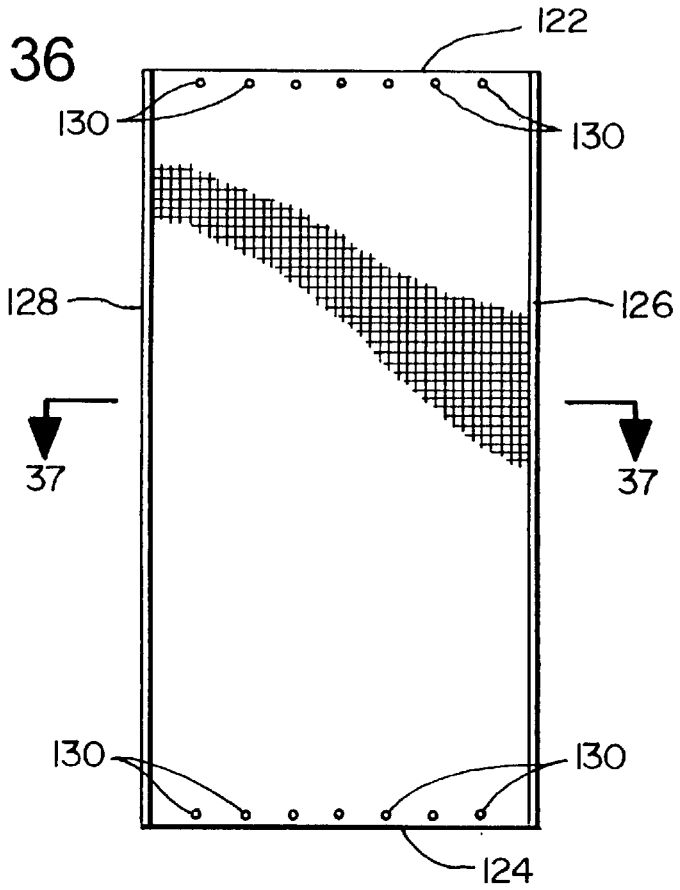
FIG. 36 is a front view of the screen.

As shown in FIG. 36, the screen 118 has an upper lateral edge portion 122, a lower lateral edge portion 124, a first lateral vertically extending portion 126, and a second lateral vertically extending portion 128. Located in the upper and lower portions 122 and 124 are a plurality of buttons 130. As shown in FIG. 34, the buttons 130 have a transverse width indicated at 132 that is slightly greater than the width of the slideway 56. As shown in FIG. 35, a central portion 134 of the button is flexible with respects to the housing 136. Therefore, as seen in FIGS. 32 and 35, if the screen is removed from the upper or lower bracketing systems, the buttons 130 will release from the interior chamber 60 and the screen 118 will not tear or otherwise be damaged. When the screen 118 is withdrawn back into the screen dispensing system 26 the buttons 130 are thereafter aligned to be withdrawn back into chamber 60 of the inner elongate member 30. The manufacturing process of installing the buttons 130 and constructing the screen 118 is discussed further herein below.

The buttons 130 comprise a central portion 134, a housing 136, and a plurality of extensions 137. As seen in FIGS. 34 and 35, the central portion 134 has a base connector 139 mounted to the housing 136. The base connector 139 provides transverse displacement of the central portion 134 as shown in FIG. 35. As shown in FIG. 35, the button 130 is adapted to be removed from the chamber 60 with moderate resistance through the laterally extending slideway 56. From a preferred form and manufacture, the extensions 137 extend through the square openings of the screen 118 in the regions 122 and 124 and are received by a hot iron that melts the extensions 137 to the screen 118.

Figure 38:
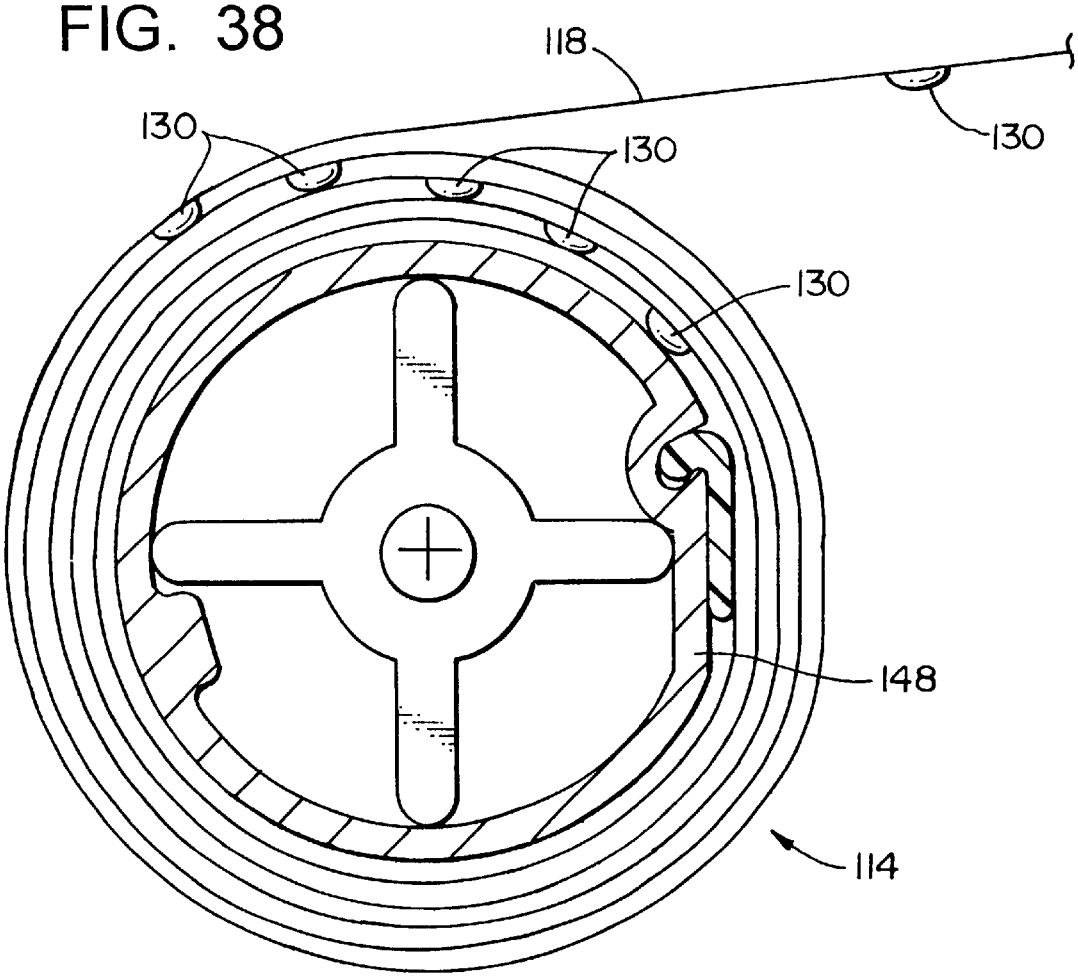
FIG. 38 is a sectional view of the screen wrapped around the elongate tube the screen retraction system illustrating the lateral space seen that the buttons to not radially stack upon one another when rolled about the elongate tube.

As seen in FIG. 38, the lateral spacing of the buttons is done in such a manner so when the screen is rolled about shaft or elongate tube 148, the buttons 130 are not stacked above each other in the radial direction to cause tumor like radially extending extensions in the spring-loaded screen extension system 114.

Figure 37A:
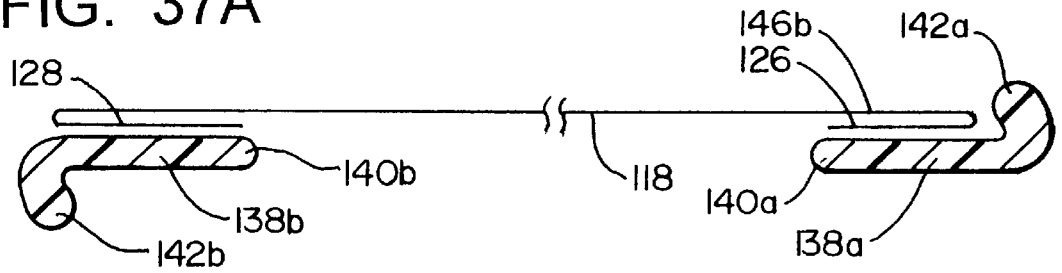
FIG. 37*a*, 37*b* is a horizontal broken sectional view of the screen taken at line 37—37 in FIG. 36.
Figure 37B:
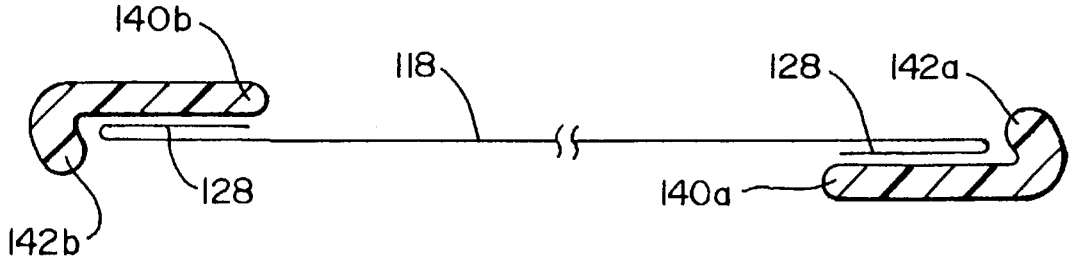

There will now be discussion of the screen 118 with reference to FIGS. 32–37. Located in the first and second lateral portions 126 and 128 of the screen 118, a spline 138 is attached thereto. The spline 138 has a lateral portion 140 and a flange portion 142. The flange portion has an interior engagement surface 144 described further herein. As seen in FIG. 37, the flanges 142 are located on opposite sides of the screen 118. Therefore the screen 118 can be installed in the screen dispensing system 126 using either spline 142*a* or 142*b*. As shown in this FIG., the preferred form constructing the screen 118 is two fold at region 146 of the screen 118 and glue the flange 140 thereto. The preferred method of installing the spline 140 to the peripheral regions 126 and 128 of the screen 118 is to glue the spline thereto the vertical portions 126 and 128. As shown in FIG. 37*b*, the splines 142 have the same inverted arrangement; however, the folded region at 128 is positioned on the opposite sides as the folded region indicated at 126.

Figure 26:
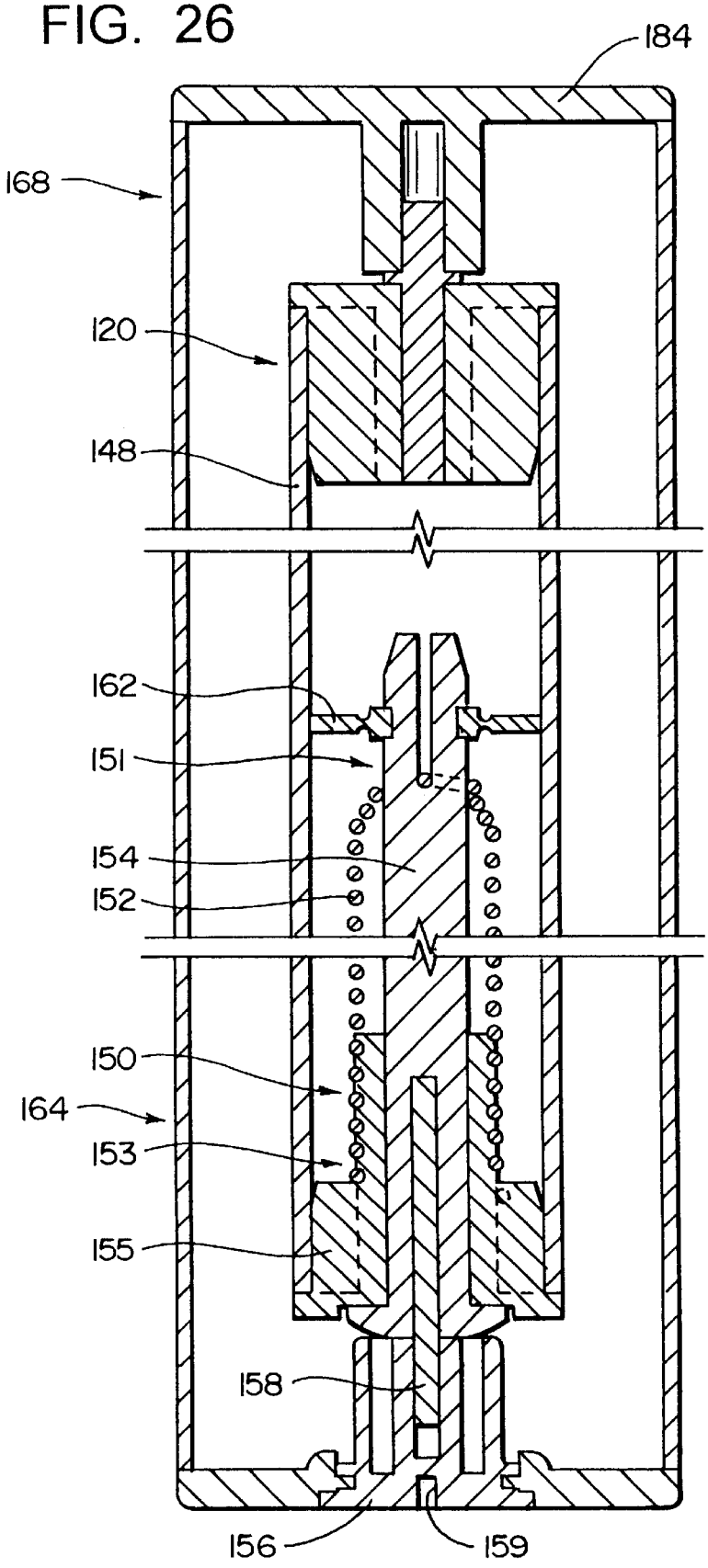
FIG. 26 is a vertical broken sectional view of the spring-loaded screen extension system.

As seen in FIG. 26, the screen retraction system (or dispensing and retracting mechanism) 120 comprises an elongate tube 148 and a spring system 150. The spring system 150 has a first portion 151 and a second portion 153 and comprises spring 152, inner rod 154, end cap 155 and an adjustment cap 156. The inner rod 154 has an extension region 158 discussed further herein. The spring 152 is rigidly attached to the first portion 151 of the spring system 150 of inner rod 154 and the vertically opposite portion of spring 152 is rigidly attached to the adjustment cap 156. Therefore, when the extension 158 is rotated with respects to the upper cap 155 the spring 154 is placed in rotational tension. The spring system 150 further comprises an outer protective casing 160 (not shown in FIG. 26) and a spacing element 162. The protective casing 160 surrounds the screen 152. Both of these members can rotate freely regardless of the spring 152 tension and are not directly necessary for the screen retraction operations.

The elongate tube 148 has a first portion 164 and a second portion 168. As shown in FIG. 2, indentation 170 extends vertically along the outer surface and is adapted to receive the flange 142 on the spline 140 of the screen 118. The replacement of the screen 118 can be accomplished very easily by removing the elongate tube 148 from the outer shell 112 and removing the spline 140 from the indentation 170. The screen is further removed from the handle 115 by removing the bumper 222 from the connection region 202.

Figure 31:
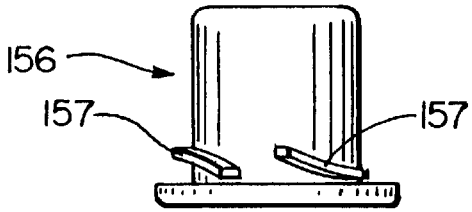
FIG. 31 is a side view of the adjustment cap.

Now referring back to FIG. 26, the outer surface of the cap 155 is adapted to be received by the interior hollow portion of the elongate tube 148 and frictionally engage thereto. Therefore the entire elongate tube 148 rotates with respect to cap 155. The extension 158 is adapted to be received by adjustment cap 156. Therefore adjustment cap 156 will rotate interior rod 154. As shown in FIG. 31, the adjustment cap 156 has a plurality of tangentially inclined ridges 157 that are adapted to engage the forward portion of ridges 196 in the ratcheting region 188 of the enclosure cap 182 discussed further herein below. A central surface 159 creates a recessed region that is adapted to receive the head of a screwdriver for adjustment discussed further herein.

Figure 27:
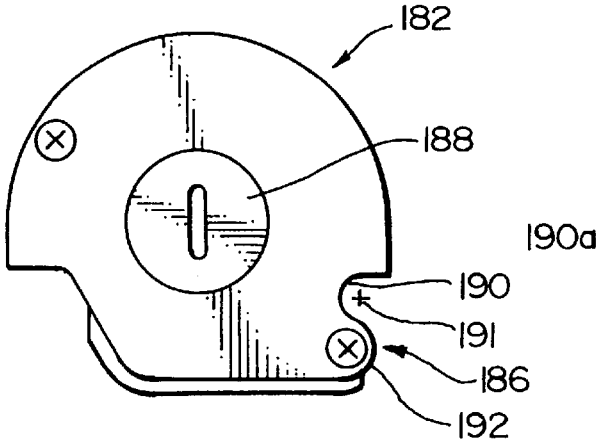
FIG. 27 is a view of the first end cap showing the ratcheting region and the connection region.
Figure 28:
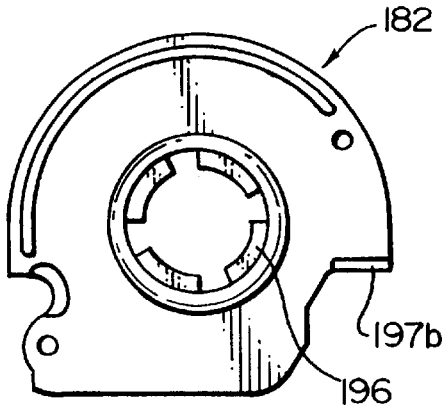
FIG. 28 shows the opposite sides of the first end cap shown in FIG. 27 showing the central tangentially inclined ridges of the ratcheting region.
Figure 29:
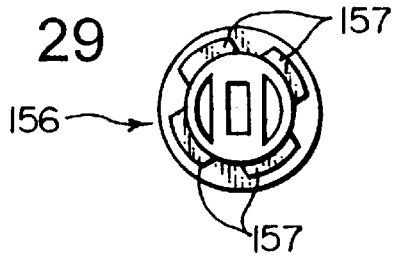
FIG. 29 shows the adjustment cap.

As shown in FIGS. 2 and 27–30, the outer shell 112 comprises an elongate casing 180, a first enclosure cap 182 and a second enclosure cap 184. As seen in FIG. 27, the first enclosure cap 182 comprises a connection region 186 and a ratcheting region 188. The connection region 186 is adapted to be received by the second mounting region 264 of the vertical brace 86. The connection region 186 comprises a receiving recessed portion 190, an extension portion 192, and a sealing surface 197. The connection region 186 is adapted to work in conjunction with the connection region 186 of the first enclosure 182 and the locking surface 185 of the elongate casing 180 to lock the screen extension assembly therein. The receiving recessed region 190 has a cylindrical surface in a horizontal axis about a center 191. Located on the inward surface is a recessed notch region 190*a*. The extension portion 192 is additionally rounded and adapted to engage recessed portion 274 (see FIG. 18). The sealing surface 197 is adapted to engage the receiving surface 278 of the vertical brace 86. The sealing surface 197 comprises a to extension 197*a* and a recessed region 197*b* (see FIG. 28).

The vertical brace 86 in combination with the outer shell 112 is referred to as a housing 87. As shown in FIG. 27, the enclosure caps 182 and 184 can be attached to the elongate casing 180 via screws that are adapted to be received in elongate slots that are extruded in the outer casing 180.

Figure 30:
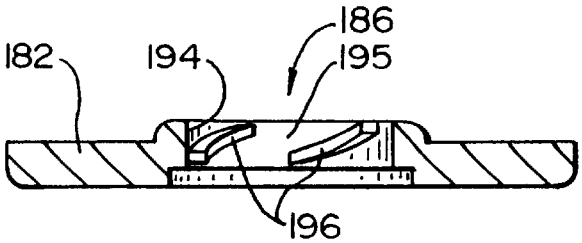
FIG. 30 is a vertical sectional view of the first end cap showing the tangentially inclined ridges.

As seen in FIG. 30, the ratcheting region 188 has a surface 194 that defines the central opening 195. The surface 194 further defines tangentially inclined ridges 196 adapted to engage the ridges of adjustment cap 156.

The second enclosure cap 184 is similar to the upper end cap 182 except without a ratcheting region 188. Alternatively, best seen in FIG. 26, a surface defines a circular indentation adapted to receive the first portion 168 of the elongate tube 148 allowing the elongate tube 148 to rotate about a vertical axis. The connection region 186 of the upper end cap 182 is applicable to the lower end cap 184 as well.

Shown in FIG. 2, the elongate casing 180 has a laterally inward region 181 and a laterally outward region 183. A locking surface 185 is located in a laterally outward region and comprises a first extension 187 and a second extension 189. The first extension has a laterally outward vertically extending extension adapted to engage the locking system 293 of the L-shaped member 250 discussed further herein below. A transverse surface 191 located in a laterally inward region 181 defines a vertically extending gap 306 in conjunction with surface 302 of L-shaped member 250.

There will now be a discussion of the handle 115 which is a subcomponent of the screen dispenser 84 (other subcomponents been outer shell 112 and spring-loaded screen extension system 114). As shown in FIG. 2, the handle 115 comprises an elongate member 200, a vertically extending connection region 202, a lower connector 204, an upper connector 206, and a seal 208. The elongate member 200 has a laterally inward region 210 and a laterally forward region indicated at 212. Further, member 200 has an outward transverse portion indicated at 214 and an opposite inward transverse portion indicated at 216. The connection region 202 is located in the laterally inward region 210 and comprises a first ridge surface 218, a second ridge surface 220 and a bumper 222. The first and second ridge surfaces 218 and 220 cooperate to form locking slot 223. The bumper 222 comprises an outward surface 224, an inward surface 226, and a laterally inward impact region 228. The surface 224 is adapted to frictionally engage the first ridge surface 218, and on the opposite side of the bumper 222 the inward surface 226 is adapted to press the flange portion 140 of the screen 118 to the second ridge surface 220. The interior engagement surface 144 of the flange portion 142 located on the spline 138 engages the second ridge surface 220 to hold the spline 138*a* therein. To remove the screen 118 from the handle 115, the bumper 222 is pried from the locking slot 223 and the spline 138*a* his removed therefrom. It should be mounted to the spline 138*b* can be removed from the elongate tube 148 of the screen retraction system 120 described further herein below when discussing the method of replacing the screen 118.

The laterally inward impact region 228 of the bumper 222 has a second purpose for providing an impact surface 230 that is adapted to engage the transverse surface 191 of the elongate casing 180. The impact region 228 has an interior cavity that allows lateral displacement of the impact surface 230. The lateral displacement allows the acceleration of the handle 115 when the handle strikes the elongate casing 180 of the screen dispenser 84.

Figure 20:
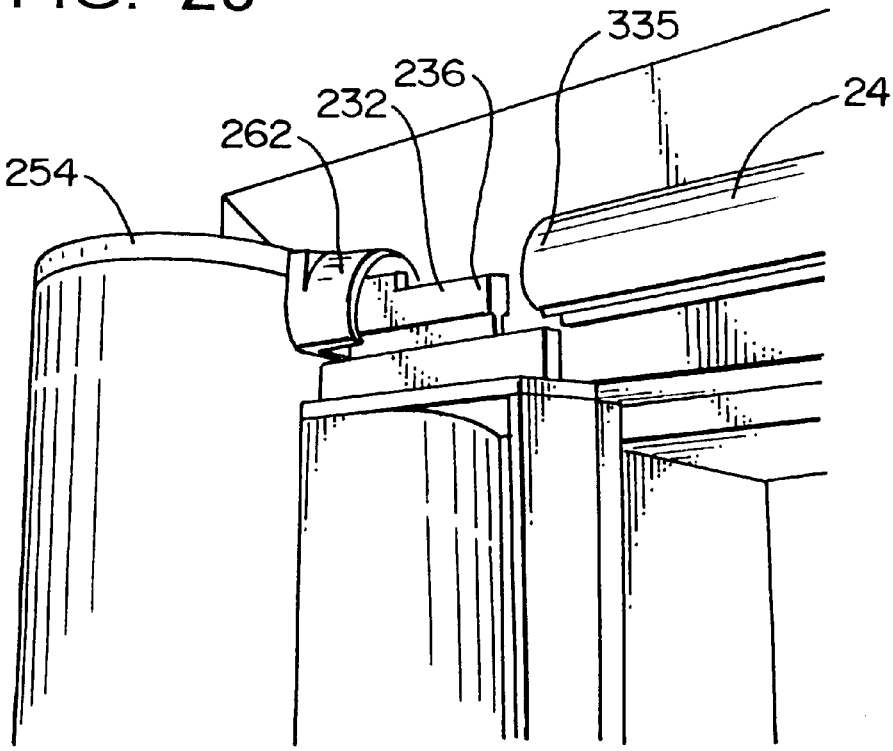
FIG. 20 shows the mounting region of the upper bracketing component being inserted into the first mounting region of the end cap of the vertical brace.

The first and second connectors are 204 and 206 are substantially similar and hence connector 206 will be described in detail with the understanding the components and description thereof correlate and relate to connector 204. As shown in FIG. 20, the connector 206 comprises a slot retention member 232 and a fastener region 234. The slot retention member 232 has an extension 236 that has a transverse width indicated at 238 that is wider than the slideway 56 of inner elongate member 30 of the lower bracketing component 22. The slot retention member 232 further has a neck portion 235 that has a transverse width narrower than slideway 56 and hence can freely slide laterally therein.

The faster region 234 as shown in FIG. 51, comprises the locking surface 237 is adapted to receive the vertical members 72 and 272 of the lower and upper bracketing components 22 and 24. The engagement surface 237 has engagement notch 237 that engages the surface 75 and 375 to lock the handle 115 in the retracted position.

A second feature of the fastener region 234 is the biasing piece 239. The biasing piece 239 has a forward surface 239*a* and a rearward surface 239*b*. As shown in FIG. 51, as the biasing member is inserted into the open region 245, the surface 239*a* exerts pressure upon the surface 237*b*. Alternatively, the surface 239*a* would exert minimal to zero pressure upon surface 237*b*. However, if the handle 115 is not remain in the withdrawn position, or additional pressure is required to maintain the handle an open position such as the French door embodiment illustrated in FIG. 46, greater force can be exerted upon the surface 237*b* to locking the vertical members 72 and 372 therein. As shown in FIG. 52, the surface 239*b* is pressing upon the surface 237*b* exerting greater force thereon. As shown in FIG. 51, the lateral distance from surface 239*b* to surface 239*c* is greater than the lateral distance between 239*a* and 239*d*. Therefore, as shown in FIG. 52, as surface 239*c* presses upon surface 237*c*, a greater force results from surface 239*b* upon surface 237*b*. This creates a greater moment about the base portion of the connector 234 and hence greater pressure of surface 237*a* upon the vertical extending members 72 and 372.

The seal 208 extends vertically along the elongate member 200. The seal 208 comprises an elongate strip of flexible plastic 240 that is positioned in the vertically extending slot 242 of the elongate member 200. The flexible plastic 240 has a first region 241 and a second region 243. The first region 241 is adapted to engage the molding 16 to create a seal. The second portion 243 is adapted to engage a reciprocating seal 208 in a French door arrangement discussed further herein below.

In general, the elongate member 200 has an S-shaped configuration shown in FIG. 2 that is particularly advantageous for grasping. The entire length of the elongate member 200 can function as a handle for positioning the screen into a retracted position and a closed position. Therefore, there is no need to further install a handle to the vertically central portion of the elongate member 200.

The handle locking system 201 comprises the fastener region 234 and a vertical extending members 72 and 372 of the lower and upper bracketing components 22 and 24. In general, the first surfaces 73 and 373 of the vertically extending members 72 and 372 separate the engagement surface 237 of the fastener region 234 (see FIG. 6). As the handle 115 is displaced in the extracted position the transversely inclined surfaces 75 engage the engagement surface 235 to keep the handle 115 and the retracted position.

There will now be a discussion of the vertical brace 86 with reference to FIGS. 13, 16–18 and 42. In general, the function to the vertical brace is to mount the screen dispensing system 84. The vertical brace 86 is adapted to be retrofitted to the lateral portion of a door molding 16. To reiterate the hierarchy of the component reference names, the vertical brace 86, and the screen dispensing system 84 are collectively referred to as the screen dispenser 26.

Figure 16:
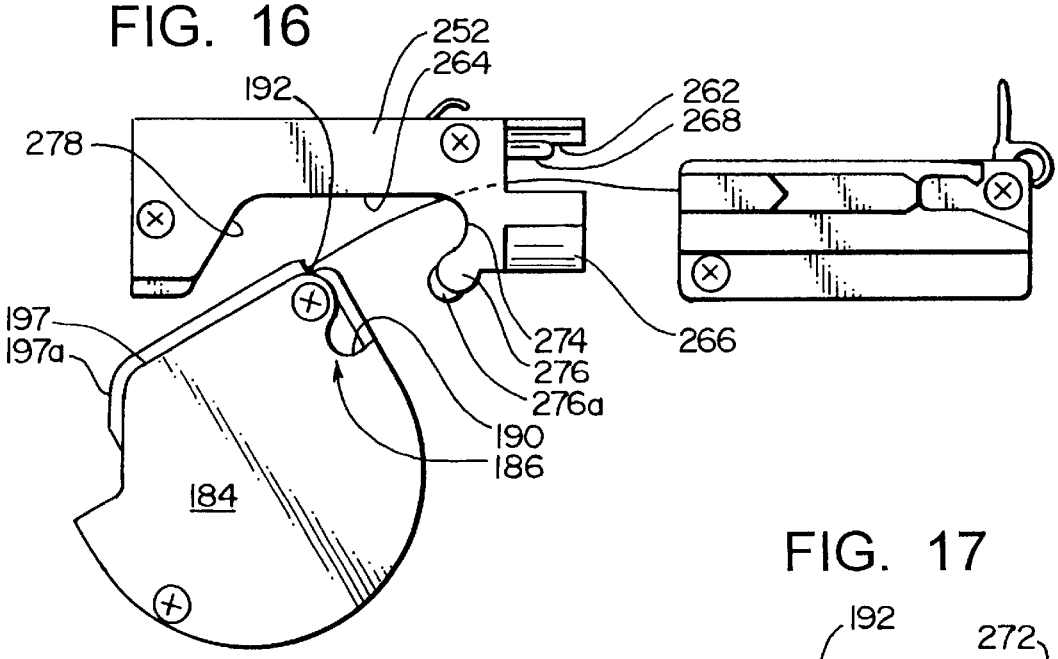
FIG. 16 is a top view of the substantially vertical screen dispenser showing the screen dispenser in a position to be mounted to the vertical brace.
Figure 17:
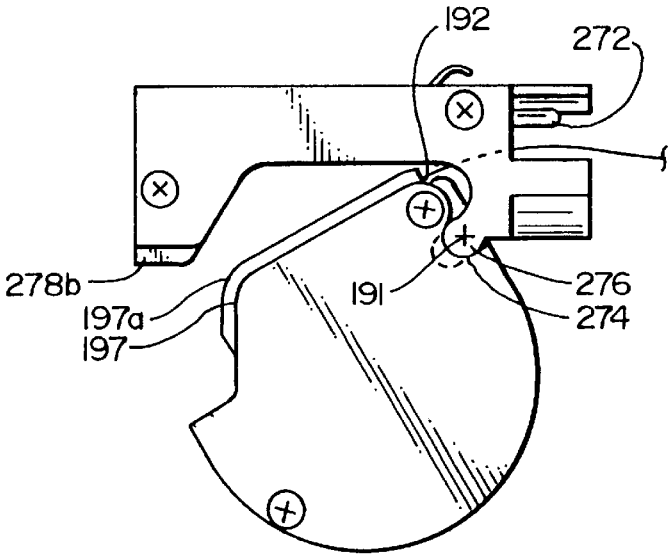
FIG. 17 is a top view showing the connection region of the outer shell engaging the extension of the end cap.
Figure 18:
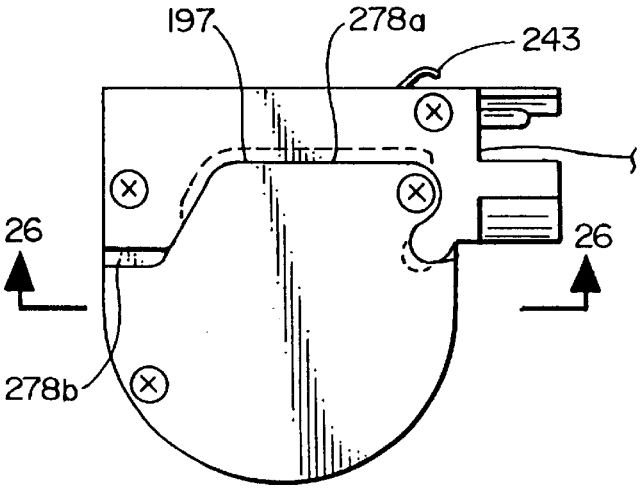
FIG. 18 shows the outer shell rotated clockwise about a vertical axis indicated at 191 to a locking position.

The vertical brace 86 comprises an L-shaped member 250, a first end cap 252, and a second end cap 254. The L-shaped member 250 has an upper region 256, a central region 258 and a lower region 260. As seen in FIGS. 16–18, located in the upper region 256 is the upper end cap 252 which comprises a first mounting region 262 and a second mounting region 264. The first mounting region 262 comprises an outer housing member 266 and an inner attachment member 268. The inner attachment member 268 has radially inward slots 270 that are adapted to receive the laterally extending notches 59 of the inner elongate member 30. The radially inward slots 270 are advantageous in aligning the slot region 272 with a laterally extending notches 59 of the inner elongate member 30 and do so is similar manner as the end pieces 32.

The second mounting region 264 comprises a recessed portion 274, extension 276 and receiving surface 278. The recessed portion 274 and extension 276 are both circular in an inverted S-shaped configuration. The significance of this configuration will be discussed further herein in conjunction with the description of the end cap 182 of the screen dispensing system 84. The receiving surface 278 has a recessed region 278*a* (see FIG. 18) and an extension 278*b* that is adapted to engage recessed region 197*b* of outer shell 112.

The lower end cap 254 is very similar to the upper end cap 252 except inverted about the horizontal plane. Further, the upper and lower regions vertical brace 86 are substantially similar and therefore can be mounted to the left or right portion of a door sill discussed further herein below.

The L-shaped member 250 comprises a first flange 290, a second flange 292, and a seal 293. The first flange 290 extends in the transverse direction and has a locking system 293 which comprises a first extension 294 with an inward surface 295 and a second extension 296 that has a vertically extending lip 297 with the forward portion 299 and a rearward engagement surface 301.

The locking system 293 cooperates with the locking surface 185 on the elongate housing 180 of the outer shell 112 to lock the screen dispenser 84 to the vertical brace 86 described further herein.

The second flange 292 extends in the lateral direction and has a rearward surface 298 and a forward surface 300. A portion of the rearward surface 298 defines a slot that extends vertically is adapted to hold the base portion of seal 293. The extension 302 is somewhat rounded and cooperates with surface of laterally inward region 181 on elongate case in 180 of outer shell 112 to form a vertically extending gap 306.

Figure 13:
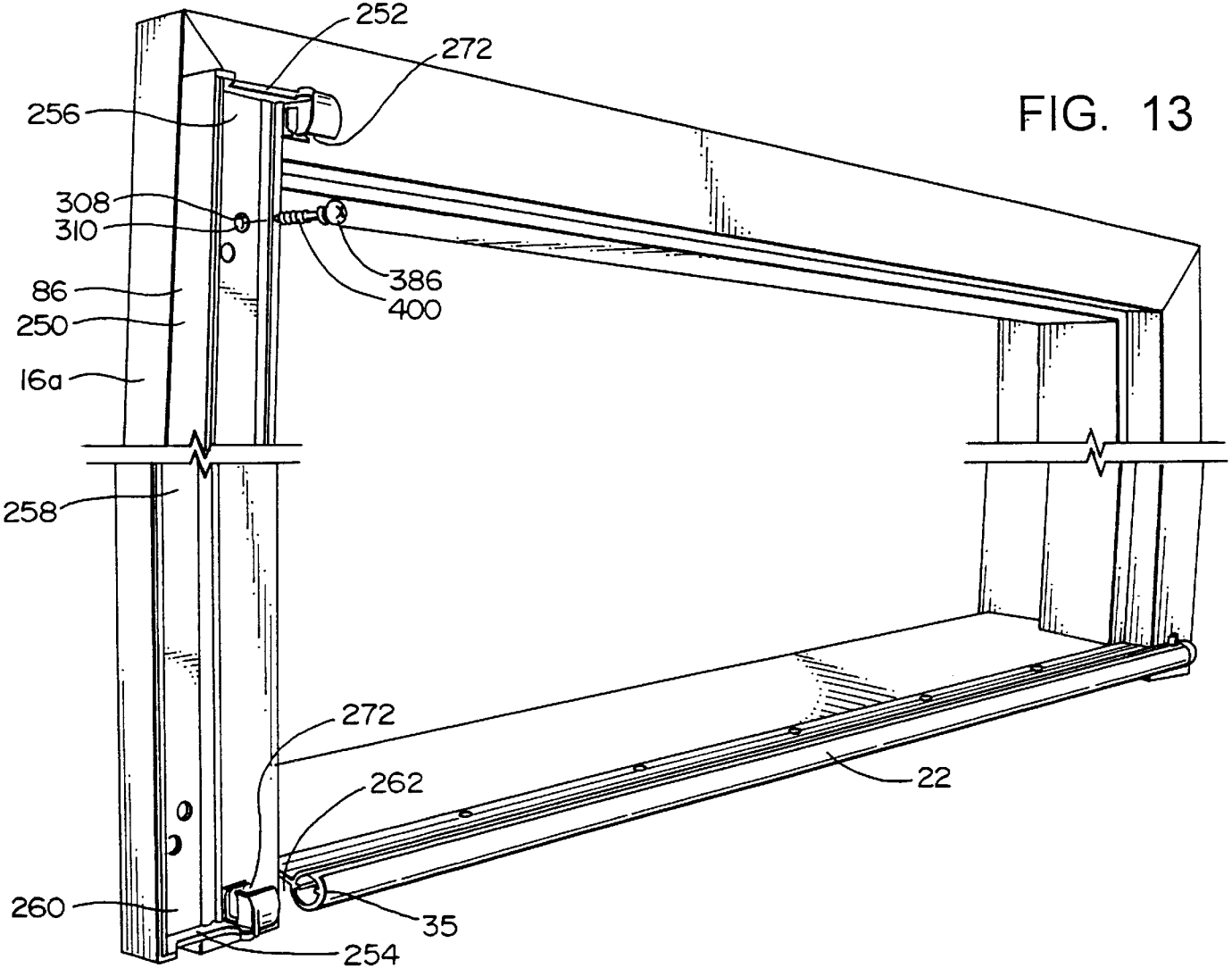
FIG. 13 is a partially broken view showing the lower and upper portions of the vertical brace and the lower bracketing component.

As seen in FIG. 13, the second flange 292 further has a locking surface 308 defining an opening 310 that is circular in the preferred embodiment. The L-shaped member 250 as at least one locking surface 308 that cooperates with double threaded screw 384 of the connector system 27.

There will now be a description of the upper bracketing component 24 with reference to FIGS. 3 and 5–7. In general, the upper bracketing component 24 is very similar to the lower bracketing component 22 described above with the main difference been the base extension 40 of the outer elongate member 28 is not present in the upper bracketing component 24. Further, an upper seal system 340 is present in the upper bracketing component 24.

The upper bracketing component 24 comprises an outer elongation member (elongate member) 328, an inner elongate member 330, an end piece 332, and retention pieces 361. The outer elongate member 328 comprises a cylindrical member 336 having a center 338 and a seal system 340. The cylindrical member 36 has an outer surface 350, and an inner surface 353. The combination of outer and inner surfaces 350 and 353 define a longitudinal gap 352. It should be noted, as with the lower outer elongation member 28, that a cylindrical interior surface is preferred because it will intimately engaged the outer surface 354 of the inner elongate member 330. However, is possible to have a functioning upper bracketing component 24 with a non cylindrical outer elongate member 328. The seal system 340 comprises a laterally extending slot 341 and a laterally extending seal member 343. The laterally extending seal member has a base portion 345 adapted to engage the laterally extending slot 341.

The inner elongate member 330 comprises an outer surface 354 and an inner surface 358. The combination of services 354 and 358 define a longitudinally extending gap or slideway 356 that has a laterally extending center point indicated at 362. The outer surface 354 is cylindrical about center point 338. It is important that the inner elongate member 330 can rotate about the lateral axis with respects to the outer elongate member 328. The inner surface 358 defines an inner chamber 360 that is adapted to house the buttons 130 of the screen 118. The laterally extending center point indicated at 362 defines the upper portion of the bracketing plane 119. To reiterate the significance of the bracketing plane 119, in operation the bracketing plane 119 is an alignment or very close to alignment with the screen 118 and is parallel thereto. The laterally extending centerpoints 62 and 362 of the lower and upper bracketing components 22 and 24 define the bracketing plane. It should be noted that in operation, the screen 118 may be offset from the bracketing plane a small distance to do the transverse displacement caused by the buttons 130 (see FIG. 34). Further, the bracketing plane extends to the vertically extending gap 306 (see FIG. 2) as well as the slots regions 272 of the end caps 252 and 254 (see FIG. 13).

To maintain the inner elongate member 330 within the outer elongate member 328, the retention pieces 361 are employed. It should be noted that in the preferred embodiment the retention pieces 361 as well as the end and piece 332 are identical to retention pieces 61 and end piece 32 of the lower bracketing component 22. The retention pieces 361 have an extension 365 that extends in a surface located at the lateral and portions of the outer elongate member 328 to fix the retention pieces 361 thereto. As shown in FIG. 3, the retention pieces 361 have a recessed region 363 that tangentially extends a small distance and are adapted to engage the shaft portion 367 of and pieces 332. The recessed region 363 allows the end pieces 332 to rotate a small distance about the lateral axis to align the slideway 356 of the inner elongate member in the bracketing plane.

The end piece 332 comprise a shaft portion 367 and a head portion 369. The shaft portion 367 comprises a locking mechanism 371 and a vertically extending member 372. The locking mechanism 371 has a notch assembly 375 that is adapted to extend in the recessed region 363 of the retention pieces 361. The recessed region 377 allows the end piece 332 to be removed from a retention piece 361 in the event when the installer inserts the end piece 332 into the wrong and end must withdraw it therefrom. The vertically extending member 372 is adapted to engage the upper connector 206 of handle 115 of the screen dispenser 84 into the open position.

The head portion 369 comprises a locking surface 381 that defines an open region 383. The locking surface 381 is described further herein relating to the mounting system 327.

We have covered the first three major components of the apparatus 20, namely the upper bracketing component 24, the lower bracketing component 22, and a substantially vertical screen dispenser 26. The final description of the main embodiment is the mounting system 27 which is integrated with the other three major subcomponents to allow the apparatus 20 to be retrofitted to almost any conventional doorframe regardless of the contour or shape of the molding 16.

Figure 24:
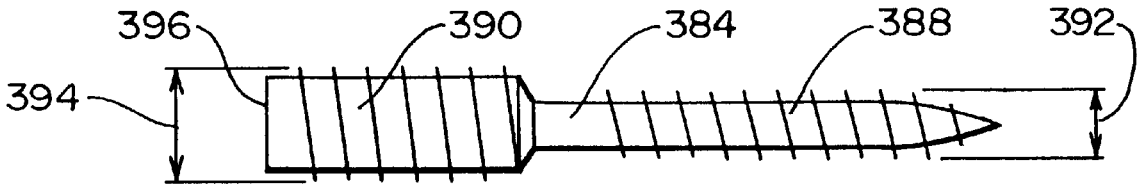
FIG. 24 shows a double threaded screw having threads on the shaft portion as well as the head portion.
Figure 25:
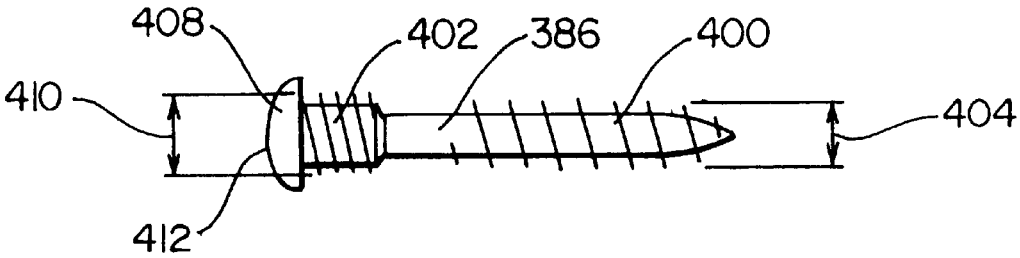
FIG. 25 shows a double threaded screw that operates on a similar concept of the screw in FIG. 24 having a threaded shaft portion of the smaller diameter than the threaded head portion.

In general, the mounting system 27 comprises a double threaded screw assembly 380 and a plurality of receiving surfaces 382. The double threaded screw assembly 380 is best shown in FIGS. 24 and 25 and comprises a first double threaded screw 384 and a second doubleheader screw 386. The doubleheader screw is 384 and 386 operate on the concept of having a threaded shaft portion that has a smaller diameter and the threaded head portion. Therefore, the threaded shaft portion can freely pass through an engagement surface adapted to frictionally engage the threaded head portion.

A preferred embodiment, the receiving surfaces 382 are locking surfaces 81, 381, and 308. The surfaces are respectively located on the lower bracketing component 22, the upper bracketing component 24, and a substantially vertical screen dispenser 26.

As seen in FIG. 24, the double threaded screw 384 comprises a shaft portion 388 and a head portion 390. The shaft portion 388 is threaded and has a diameter indicated at 392. The head portion 390 is threaded as well and has a diameter indicated at 394. The surface 396 is adapted to be received to a common screwdriver for turning the doubleheader screw 384. It should be mounted that the alignment of the threads for the head portion 390 and the shaft portion 388 are such to allow constant displacement between the locking surface engaged to the head portion 390 and the molding 16.

Now referring to FIG. 25, the second doubleheader screw 386 comprises a shaft portion 400 and a head portion 402. The shaft portion 400 is threaded and has a diameter indicated at 404. The head portion 402 comprises a threaded head region 406 and a cap region 408. The threaded head region has a diameter indicated at 410. The cap portion is adapted to be received by a common screwdriver and has a surface 412 adapted to engage a contact surface. The term double threaded screw without a reference numeral refers to either 384 or 386.

The mounting system 27 comprises at least two double threaded screws and two mounting surfaces. In a preferred form, a mounting surface is located on each of the three main components (the upper and lower bracketing components 22 and 24 and the substantially vertical screen dispenser 26). As shown in FIGS. 13, 21–23 and 44, there is shown the preferred method of employing the mounting system 27. As shown in FIG. 13, the shaft portion 400 of the doubleheader screw freely extends through opening 310. The threaded head portion 402 is adapted to frictionally engage the locking surface 308. As described further herein below, the L-shaped member is mounted to molding 16 via double-header screw 386 (two double threaded screws are shown for additional stability). It can be seen that the surface 17 of the sill 16 is "lumpy" and not uniform in the lateral direction. However, because the head portion 402 of the double threaded screw 386 is frictionally engage the locking surface 310 the L-shaped member 250 is rigidly mounted to the molding 16.

The surface 412 of the cap region 408 is adapted to engage surface 300 of the L-shaped member 250.

It should be noted that in the preferred embodiment a plurality of double threaded screws and 386 are employed to mount the substantially vertical screen dispenser 26 to any molding 16. However, the vertical mounting brace 86 requires at least one double threaded screw 386 to be effectively mounted to the molding 16.

Figure 22:
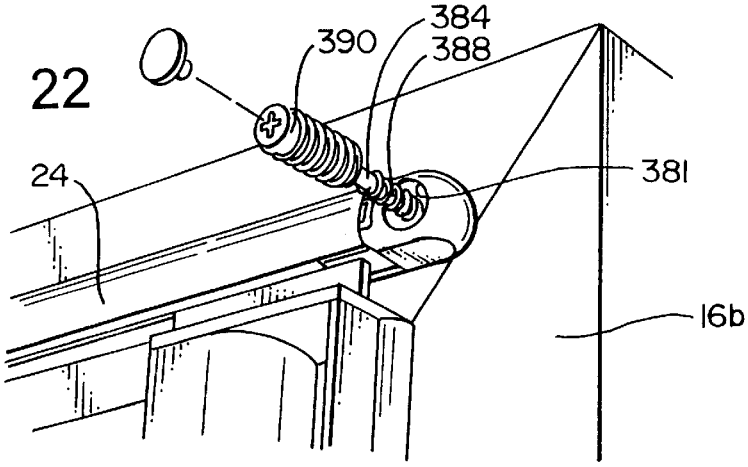
FIG. 22 shows the double threaded screw of the connector system for mounting upper bracketing member a desired distance from the molding of the door.
Figure 23:
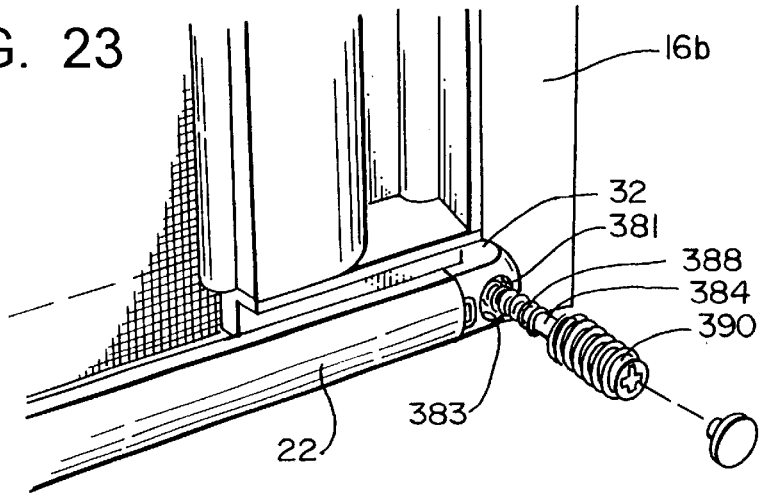
FIG. 23 shows a similar mounting procedure for the lower bracketing component using a second double threaded screw.

Now referring to FIGS. 21–23, the first double threaded mounting screw 384 is aligned in the center portion of the open region 383 and the threaded shaft portion 388 freely passes therethrough. As the double threaded screw 384 screws into the molding 16 and is displaced and the transverse rearward direction, the threaded head portion 390 eventually engages the locking surface 381 of the end piece 332. It should be noted that the threads of the shaft portion 388 have the same transverse displacement rotation as the threads of the head portion 390. Therefore, as soon as the head portion 390 engages the locking surface 381 the upper bracketing member 22 is now fixed in the transverse direction. Generally, the upper bracketing component 24 will be spaced a slight transverse distance from the molding 16.

In a similar fashion as mounting the upper bracketing component 24, the lower bracketing component 22 is mounted a similar manner using a similar double threaded screw 384. To reiterate, the lower end piece 32 is similar (or identical in the preferred embodiment) to the upper end piece 332. Therefore, the threaded shaft portion 388 passes through the open region 83 and the threaded head portion 390 is adapted to frictionally engage the locking surface 81 of the end piece 32. Therefore, the lower bracketing component 22 is mounted to the molding 16.

It should be noted that in the preferred embodiment the screw assembly 380 comprises the first and second double threaded screw 384 and 386. However, the reader can appreciate the fact that the increased diameter of the head portions of the screws is greater than the shaft portions and therefore allows a locking method that can mount the apparatus 20 to almost any surface (see FIG. 44).

The locking surface 81 is employed in the preferred embodiment; however, in some cases the base extension would provide sufficient support and the locking assembly would only be required for the upper bracketing assembly 24 and the screen dispenser 22.

There will now be brief discussion of the ratcheting system 420 which comprises the ratcheting region 188 and the adjustment cap 156. In general, the ratcheting system 420 is designed to give the interior spring a preset tension that is adapted to withdraw the screen 118 in the retracted position. The upper extension 158 is adapted to extend through central opening 196 of the enclosure cap 182. The adjustment cap 156 has a recessed interior portion adapted to receive the upper extension 158. Therefore, when adjustment of the interior spring that retracts the screen 118 is desired, the user places a flathead screwdriver in the recessed region defined by surface 159 of the adjustment cap 156 and turns it clockwise. The rearward region of ridges 157 of adjustment cap 156 disengaged from the forward portion of ridges 196 of the upper cap of the vertical brace 86 and the forward region of ridges 157 engage the rearward region of ridges 196 and the adjustment cap is displaced vertically until the lower portion of the ridges 157 extend above the upper portion of ridges 196 and the adjustment cap advances clockwise and is locked as it advances. To reiterate the function of the spring adjustment again referring to FIG. 26, as the adjustment cap 156 rotates, the interior rod 154 rotates and in turn rotates the lower portion of interior spring 152. The upper portion of spring 152 is fixed to the cap 156 which is attached to the elongate tube 148 which the screen 118 wraps therearound. If the user accidentally gets the interior spring 152 too tight, the user can lift cap 156 vertically so the upper extension 158 disengages from the slot region 157, and hence the interior spring 152 will rapidly unwind. Thereafter, the user would lower the adjustment cap 156 and rotated clockwise in the vertically oscillating self locking matter described above until the desired initial attention in spring 152 is achieved.

Figure 14:
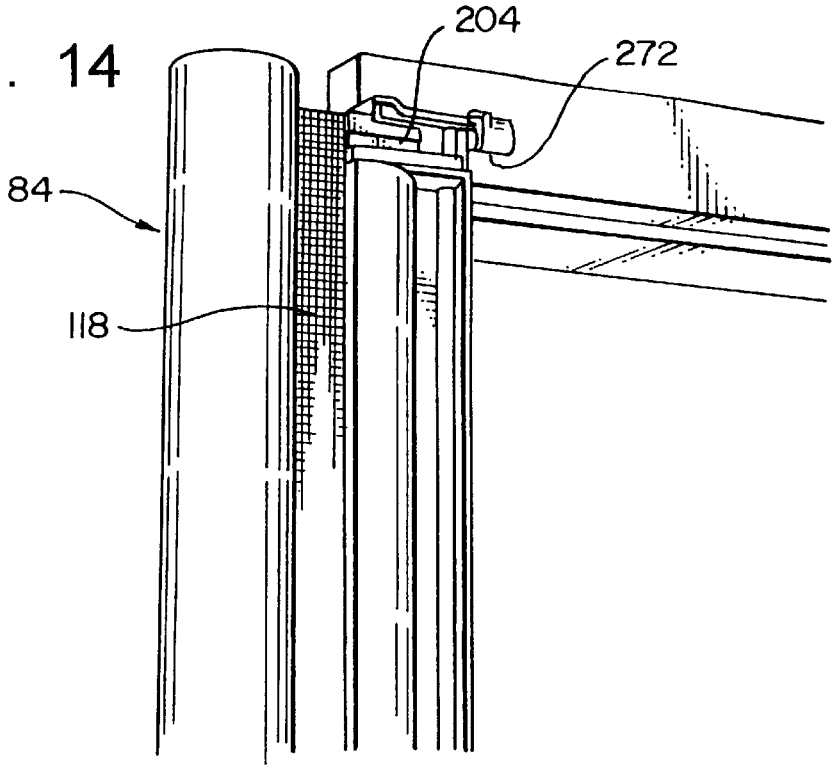
FIG. 14 shows the handle of the screen dispenser inserted into the slot region of the end cap of a vertical brace.
Figure 42:
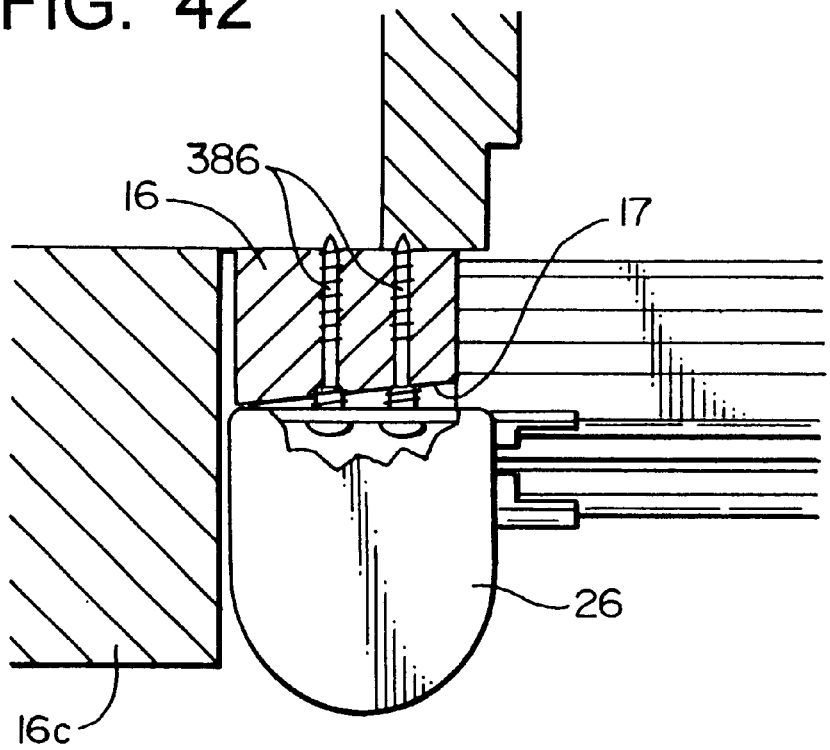
FIG. 42 is a horizontal sectional view of the apparatus illustrating how the vertical brace can be mounted to a molding that has a surface which is not aligned laterally.
Figure 43:
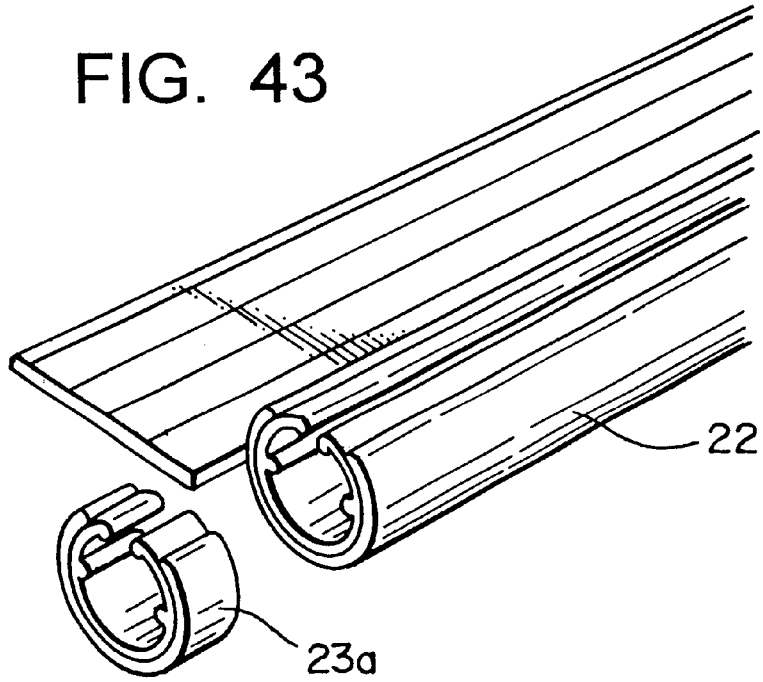
FIG. 43 illustrates how a portion of the inner and outer elongate tube is can be removed to accommodate a door frame such as the one shown in FIG. 42.
Figure 44:
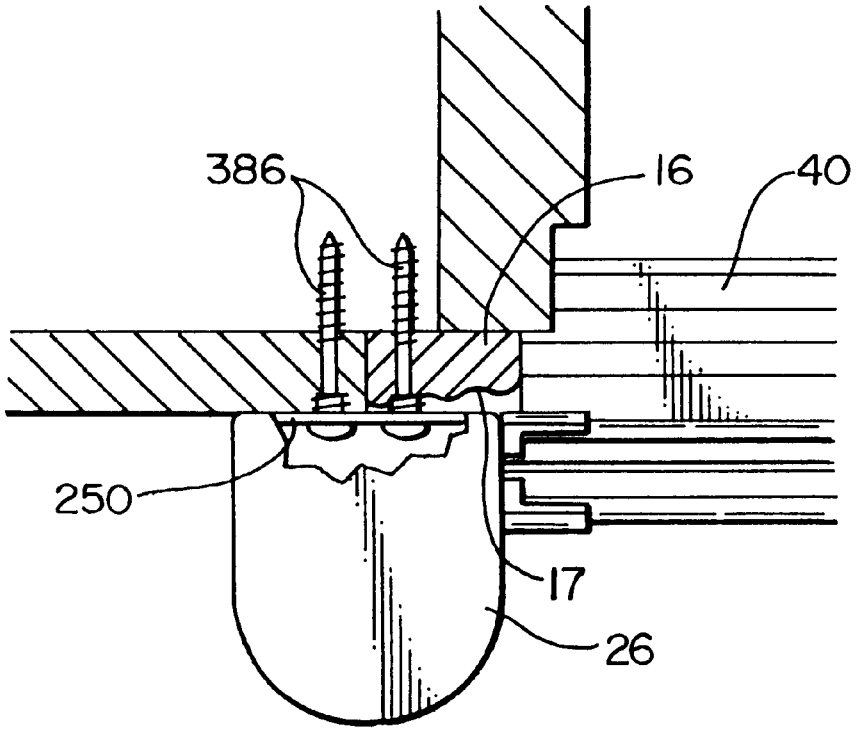
FIG. 44 shows a second door frame where the vertical brace is mounted thereto using the double threaded screws of the connector system.

There will now be a detailed discussion of the preferred method of installing the apparatus 20. The preferred installation steps are discussed with reference to FIGS. 1, 3–4, 8–23 and 39–45. In general, the apparatus 20 can be retrofitted to almost any existing hinged door. As seen in FIG. 1, the hinged door has a molding 16. As shown in FIGS. 42 and 44, the surface 17 of molding 16 can have various configurations and contours in the lateral and transverse direction. The first step the installer executes is in asserting the end cap 32 into the retention piece 61 of the lower bracketing component 22. It should be noted that the end piece 32 can be inserted into either lateral and of the lower bracketing component 22. The preferred embodiment of the invention allows installation on the left hand portion of the molding 16 such as shown in FIG. 14 are the right hand portion of the molding such as shown in the French door embodiment in FIG. 46. The versatility of the design will be better understood has a description continues.

Figure 7:
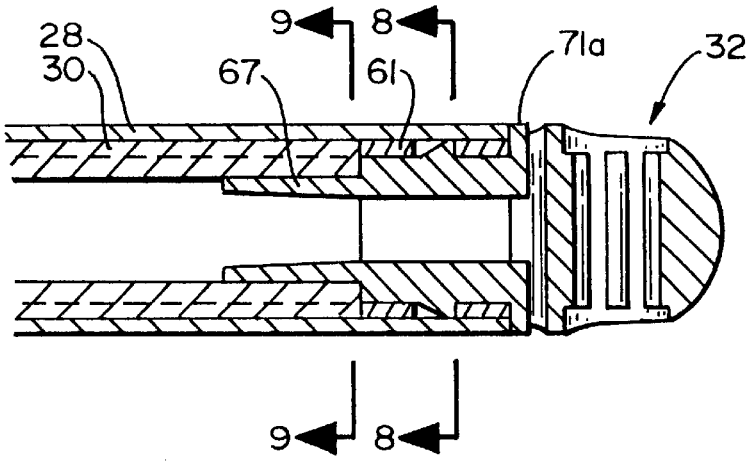
FIG. 7 is a horizontal cross-sectional view of shaft portion of the end piece fully inserted therethrough the retention piece extending therein to the inner elongate member.

If the installer inserts the end cap into the wrong lateral and of either bracketing component 22 or 24, he or she can depress the tabs 71*a* of the locking mechanism 71 to displace the much assembly 75 inwardly and out of the recessed region 63 of the retention piece 61 (see FIG. 7). It should be noted that after the slot region 73 of the shaft portion 67 of the end piece 32 is engaged with the laterally extending extensions 59, the inner elongate tube 30 will now rotate in conjunction with end piece 32 (see FIG. 10). As described above, the recessed region 63 of the retention piece 61 allows a limited rotation of the end piece with respects to the outer elongate member 28 (see FIGS. 8 and 10).

It should be noted that the end piece 332 of the upper bracketing component 24 is inserted into the correct retention piece 361 as well.

After the end piece is 32 and 332 are inserted into the mounting regions 37 and 337 respectively, the lower an upper bracketing components are aligned with the lateral with 18 of the door (see FIG. 11) the alignment of the lower bracketing is executed by positioning the laterally extreme location of the base extension 40 in alignment with the laterally inward portion of the molding 16. The upper bracketing component 24 is additionally aligned to the lower bracketing component 22 where the laterally outward surfaces of the end caps 32 and 332 are aligned in the lateral direction. Thereafter, the lateral sections 23 and 323 of the bracketing components 22 and 24 on the opposite side of the end caps 32 and 332 are removed and discarded as shown in FIG. 11. These portions of the bracketing components can be cut off with any conventional saw (e.g. a hacksaw). In the preferred form, the upper and lower bracketing components 22 and 24 arrive to the end-user having a lateral width wider than any door frame width 18. The discarded components 23 and three 23 include a retention piece 61 and 361 contained therein. As described further herein this is necessary for mounting the lower an upper bracketing components 22 and 24 into the vertical brace 86. To reiterate the flexibility of the preferred embodiment of the invention, the installation of the apparatus as shown in FIG. 11 is to install the substantially vertical screen dispenser 26 on the left hand portion of the molding 16. The substantially vertical screen dispenser 26 could just as easily be installed on the right hand portion of the molding 16. This alternative installation would only require installing the end caps 32 and 332 on the opposite lateral portions (i.e. not as shown in FIGS. 3–4). It should be noted that prior to removal of the lateral pieces 23 and 29, the installer should make sure that they are cutting off the correct side.

Figure 9:
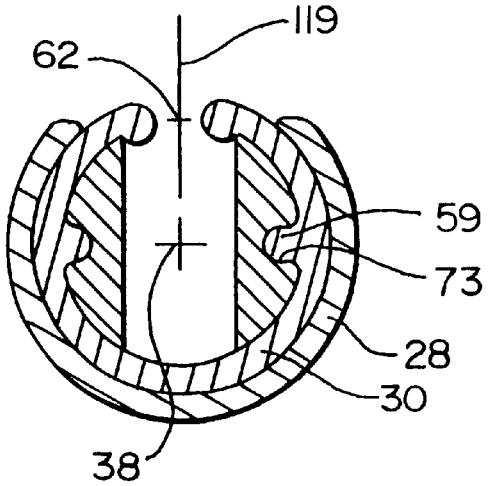
FIG. 9 is a vertical cross-sectional view taken at line 9—9 of FIG. 7 and shows an and the lateral extensions of the inner elongate member engaging the recessed region of the end piece.
Figure 10:
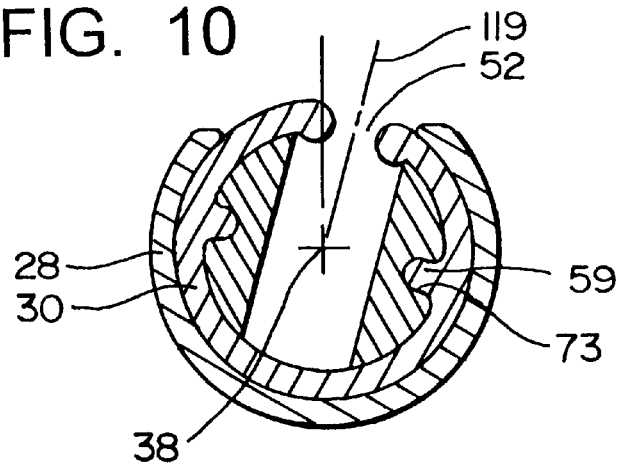
FIG. 10 is a vertical cross-sectional view taken at a similar lateral location as FIG. 9 except the inner elongate member is rotating about a lateral access with respects to the outer elongate member.
Figure 12:
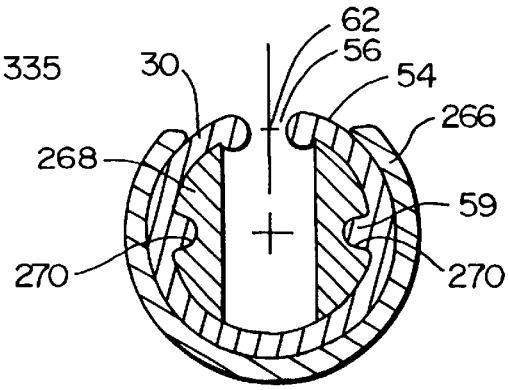
FIG. 12 is a sectional view of taken at line 12—12 of FIG. 15 showing the first mounting region engaged to the mounting region of the lower bracketing component.

The next step of installation is positioning the lower bracketing member 22 in between the molding portions 16*a* and 16*b* (see FIG. 12). Thereafter, the lower bracketing member can be fastened to the sill 77. The preferred method of fastening the lower bracketing member 22 is to fastening it with screws through openings 51. It should be noted that the openings 51 extend slightly in the transverse direction to allow transverse displacement of the lower bracketing member 22 for intermediate installation adjustment purposes. Thereafter, the vertical brace 86 of the substantially vertical screen dispenser 26 is mounted to the mounting region 35 of the lower bracketing component 22. As seen in FIG. 12, the first mounting region 35 is mounted to the first mounting region (first collection portion) 262 where the outer housing member 266 intimately engages the outer surface 54 of the inner elongate member 30. Further, the radially inward slots 270 of the inner attachment member 268 engage the laterally extending extensions 59 of the inner elongate member 30. The engagement of the radially inward slots 270 of the vertical brace 86 aligns the inner elongate member in a manner to the center lateral axis 62 is in the alignment plane. It should be noted that the engagement of the first mounting region 262 to the mounting region 35 of the lower bracketing component 22 is very similar to the engagement of the end piece 32 to the second mounting region 37 and FIG. 12 is very similar to FIG. 9. Therefore, if the sill 77 is at a sharp angle, in a similar manner as shown in FIG. 10, the inner elongate member will rotate about the center point to the proper alignment position as shown with the longitudinally extending center point 62 in the bracketing plane.

Resuming now are discussion of the preferred method of installation, referring back to FIG. 13 after the first mounting region 262 is engaged to the mounting region 35 of the lower bracketing component 22, the double threaded screws 386 mounts the vertical brace to the sill 16*a* and a manner described above. In general a whole is first grilled to the opening 310 and the double threaded screw 386 passes therethrough and is turned clockwise into the sill 16*a*. It should be noted that the installer must hold the vertical brace 86 as vertical as possible. The first mounting region 262 provides a first point of reference for rotating about a lateral axis, then the installer should use a lateral or views the sill 16 to ensure that the vertical brace 86 is align substantially vertically. It should be noted that the rearward surface 298 of the L-shaped member 250 need not be flush against the sill surface 17. As shown in FIGS. 42 and 44 the sill surfaces 17 to not provided a proper foundation for aligning the substantially vertical screen dispenser 26 any lateral direction using the prior art method of attachment. However, by employing the double threaded screws 384 of the connector system 27, the vertical brace 86 can be properly installed and aligned. A plurality of double threaded screws 384 can be used to mount the L-shaped member 250 to the sill 16*a*.

Figure 15:
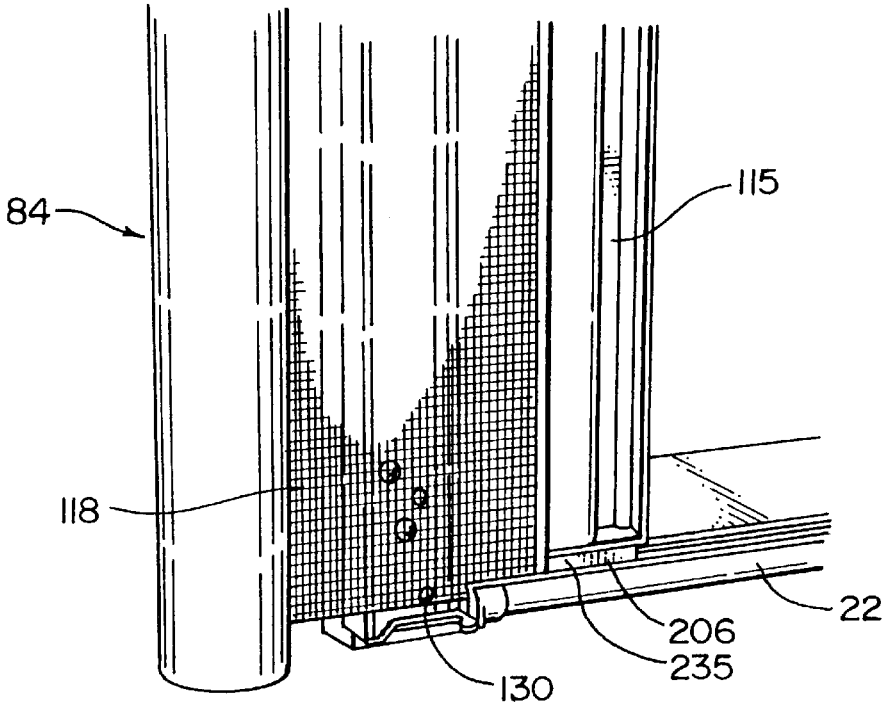
FIG. 15 shows the connector of the handle inserted in the chamber of the lower bracketing component.

The next step is to retrieve the screen dispenser 84 and inserted the lower an upper connector is 204 and 206 through the slot regions 272 of the upper and lower end caps 252 and 254 (see FIGS. 14 and 15). The extension 236 of the slot retention member 232 on the lower connector tool for that handle 115 extends to chamber 60 of lower bracketing component 22 the make portion 235 extends to laterally extending slideway 56 of the inner elongate member 30. As the and the one 15 moves toward the closed position the screen 118 is withdrawn from the screen dispenser 84 and the buttons 130 are extracted into chamber 60.

Will now be a discussion of the mounting system with reference to FIGS. 16–18. As shown in FIG. 16, the outer shell 112 is rotated about 30 degrees to counter clockwise with respects to the vertical brace 86. The outer shell 112 is positioned in a manner shown in FIG. 17 where the lip 276*a* of extension 276 is inserted into recessed notch region 190*a*. It should be noted that the connection region 186 of the first and second enclosure cap 182 and 184 are substantially similar and the FIGS. 16–18 represent the motion of both enclosure caps 182 and 184 in a synchronized manner. The receiving recessed portion 190 a circular in the horizontal plane and has a concentric center 191 with the cylindrical surface in the horizontal plane of extension 276. Therefore, the outer shell 112 can rotate about vertical axes center 191 to a position that is shown in FIG. 18. To hold the outer shell 112 in the position as shown in FIG. 18, it must be locked to the vertical brace 86. Now referring to FIG. 2, the locking surface 185 of the elongate case in 180 engages the locking system 293 of the L-shaped member 250. Specifically, the first extension 187 extends between extensions 294 and 296 of the L-shaped member 250. The laterally outward surface of the first extension engages the rearward engagement surface 301. Further, and the forward portion 299 presses upon the base portion of second extension 189 to hold the outer shell 112 thereto. It should be noted, that the outer surface of the outer shell 112 is substantially in line with the outer surface of the first flange 290 as shown in FIG. 2.

Figure 19:
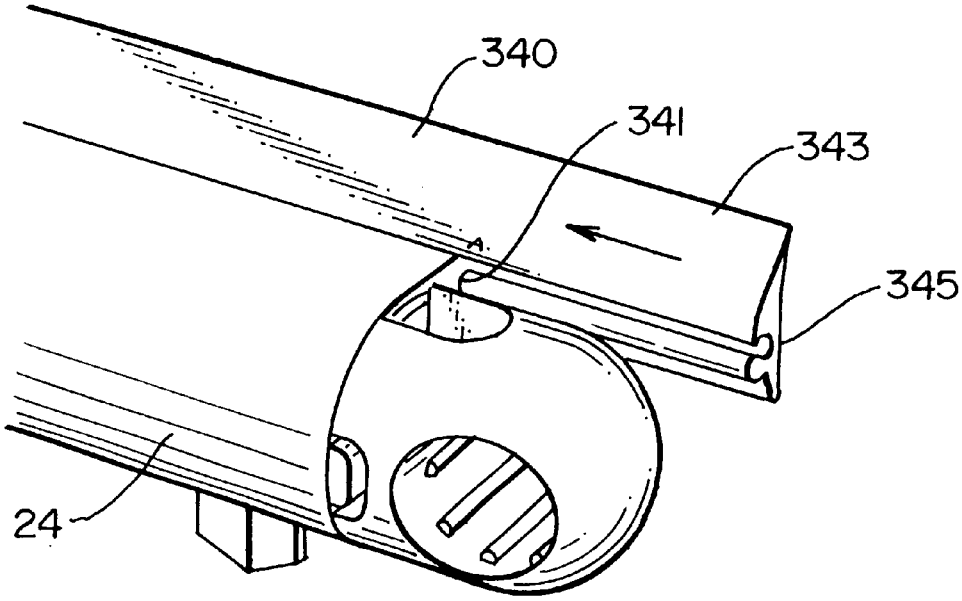
FIG. 19 shows the seal system inserted into the laterally extending slot of the outer elongate member of the upper bracketing component.

Now referring back to our assembly procedure, the seal system 340 is assembled where the base portion 345 is extended laterally in the laterally extending slot 341 of the upper bracketing component 24 (see FIG. 19). Next the mounting region 335 of the upper bracketing component 24 is inserted into the first mounting region 262 of the second and cap 254. The upper bracketing component 24 is locked and therein in a very similar manner as the lower mounting bracket 22 was locked to the L-shaped member 250 (see FIG. 12). Specifically, the inner elongate member 330 is aligned in a manner so the laterally extending center point 362 is in the alignment plane.

The next step is to employ with the second portion of the mounting system 27 with reference to FIGS. 21–23. First, the handle one 15 is positioned and an extended position as shown in FIGS. 21–23. The lower an upper connector is tool for and 206 that are positioned in the chambers 60 and 360 of the lower an upper bracketing component 24 and 24 help align the upper bracketing component 24 to a proper vertical distance from the lower bracketing component 22. And alignment tool 385 has an outer surface is in close proximity to the locking surface 381. The inner surface of the alignment tool 385 is adapted to allow a drill bit pass therethrough to create a hole in the sill 16*b*. After a hole is drilled a double threaded screw 84 is inserted therethrough opening 383 and rotated clockwise to be inserted into the molding 16*b*. It should be noted that the end piece 332 should be held a proper position and the transverse direction so the handle 115 is substantially vertical. As the double threaded screw 384 is displaced in the rearward transverse direction, the threaded head portion 390 will engage the locking surface 381 and fixedly mounted the upper bracketing member a specified distance from the molding 16.

In a similar fashion, the lower bracketing member 22 is done to the molding portion 16*b* with double toward screw 384. As a final measure, the installer would patent the screws passing through drill holes 51. This would complete installation of the apparatus 20.

Figure 45:
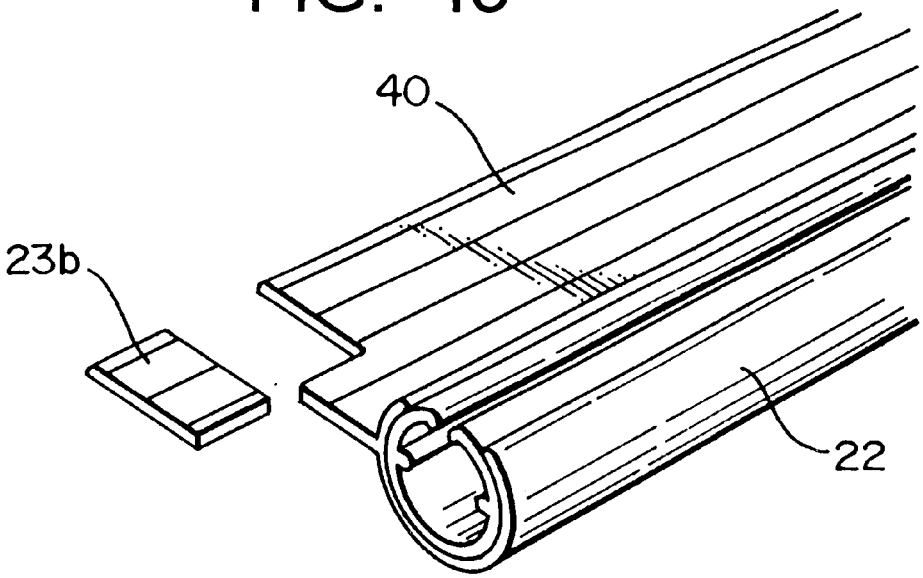
FIG. 45 illustrates how a portion of the base extension can be removed to accommodate the door frame shown in FIG. 44.

Because the installer must cut off a portion of the upper and lower bracketing component 22 and 22, the apparatus 20 can be installed into a variety of door molding and sill arrangements. As seen in FIG. 40, a block 79 is employed to raise the lower bracketing component 22 from the sill surface 77*b*. Further, as seen in FIG. 42, the surface 16*c* is not allow a lateral outward placement of the substantially vertical screen dispenser 26. Therefore, as shown in FIG. 43, the extraneous piece 23*a* can be removed from the lower bracketing component 22 to accommodate this specific door arrangement. Likewise, as seen in FIG. 44 the surface 16*d* would inherit the correct lateral placement of lower bracketing component 22. Therefore, a portion 23*b* of the base extension 40 is removed as shown in FIG. 45.

Figure 46:
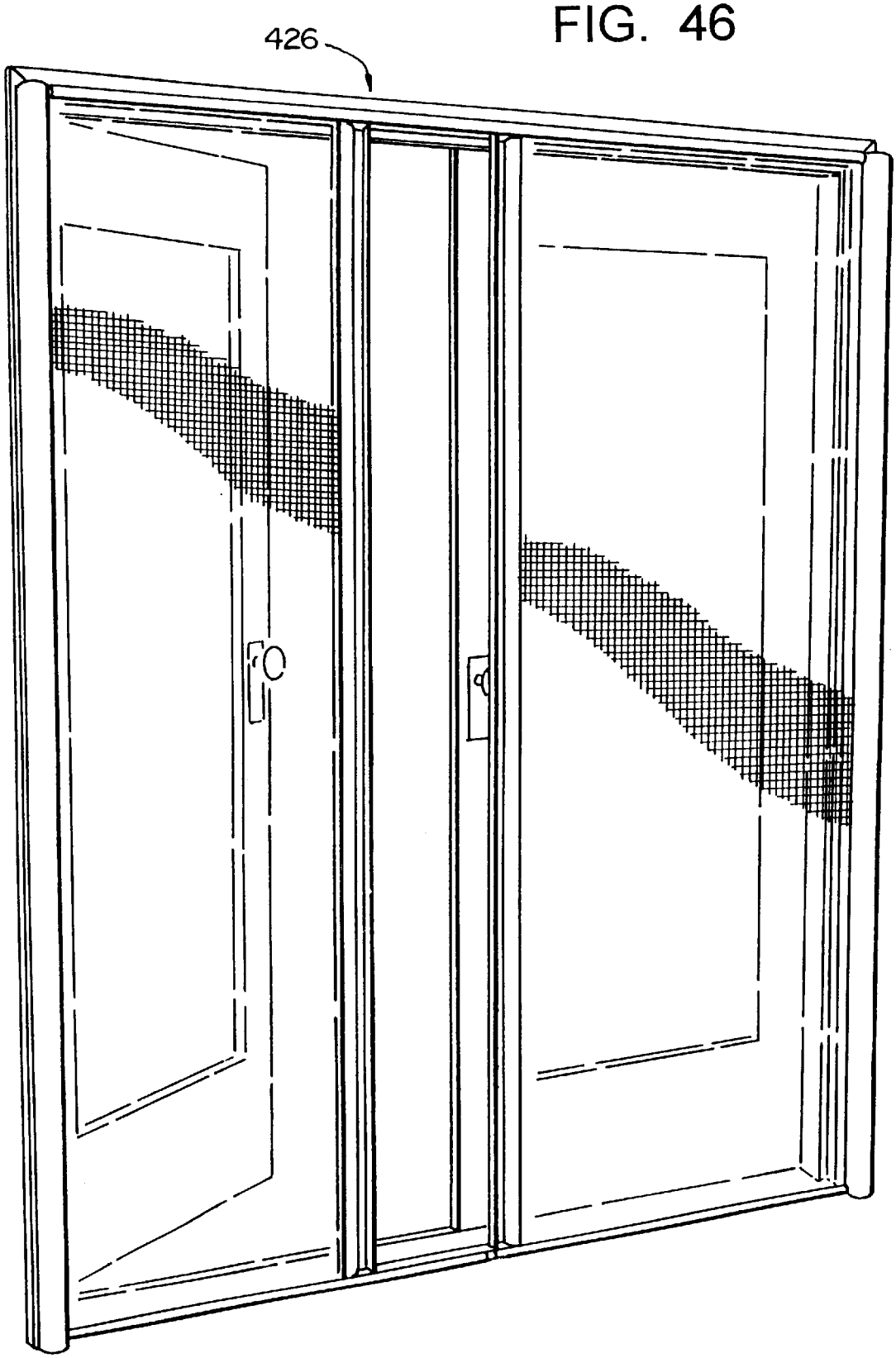
FIG. 46 illustrates a second embodiment of the present invention that is adapted to be mounted to a French door.
Figure 48:
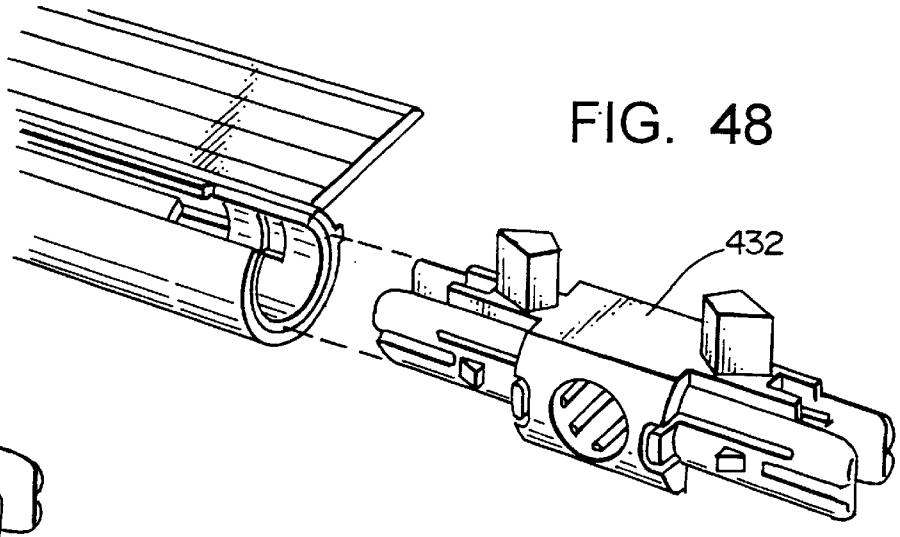
FIG. 48 shows a similar central connector to that shown in FIG. 47 that is adapted to connect two lateral aligned lower bracketing components.
Figure 47:
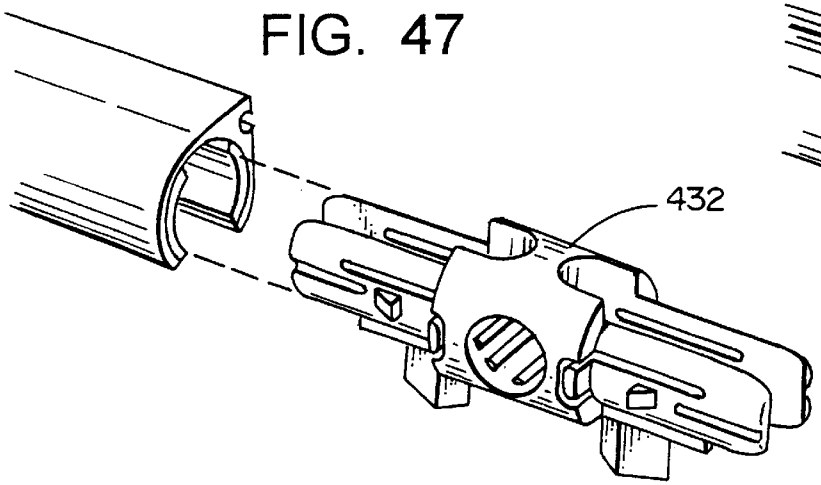
FIG. 47 shows a central connector that is adapted to connect two upper bracketing members together.
Figure 49:
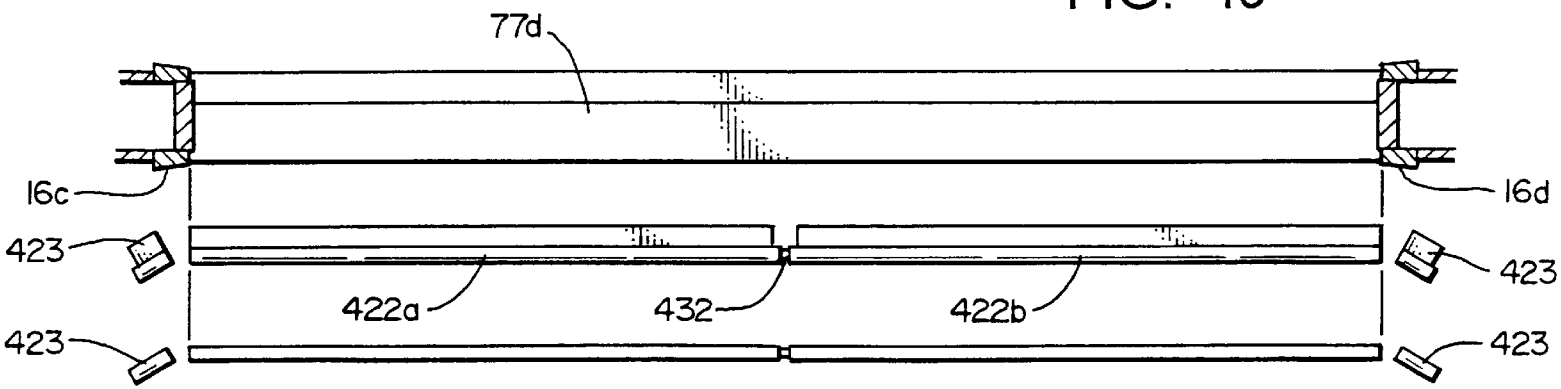
FIG. 49 shows a horizontal sectional view of a French door frame where lower and upper bracketing sets are shown where lateral and portions are removed to be properly fitted to the sill of the French door.

There will now be a discussion of a second embodiment of the present invention that is adapted to be mounted to a French door arrangement. The second embodiment is substantially similar to the first embodiment with the exception a central piece 432 is used instead of the end piece is 32 and 332. The central piece 432 is very similar to the end pieces 32 and 332 and the fact is a combination of two laterally opposed end pieces 32 attached together having a common open region 83. The installation a second embodiment is very similar to the first embodiment. As seen in FIG. 49 two lower bracketing component 22 are retrieved and connected to buy a central piece 432. The end portions for 23 are removed in a similar manner as described above. Thereafter, the vertical brace is a 6 are installed on the moldings 16*c* and 16*d* a similar manner as described above. And intermediate Piece for 44 is attached to the central region for 46 and engages the base extensions 40. It should be noted that the apparatus 20 is distributed with a single central piece 432. Therefore, if a consumer purchases two apparatus assemblies, they can install the second embodiment of the present invention onto a French door scheme as shown in FIG. 46.

Figure 8:
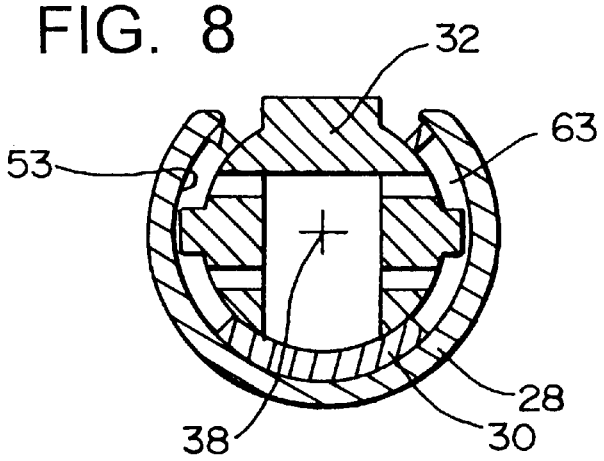
FIG. 8 is a vertical cross-sectional view taken at line 8—8 of FIG. 7 and shows the recessed region of the retention piece of the lower bracketing component.

It should be noted that the embodiments of the present invention discloses the preferred form of the invention and the various components and subassemblies are not the only way of employing the invention, but rather the scope of the invention is only to be limited by the appended claims. For example, as shown in FIGS. 8–10, the outer elongate member 28 has a circular inner surface 53 (353 for the upper bracketing component 24); however, the important aspect of the bracketing components 22 and 24 is that the inner elongate member 30 (and 330) rotate about the lateral axis. Therefore, the interior surface 53 and 353 need not intimately engaged the inner elongate member 30 or 330 and could be other cross-sectional configurations (e.g. square).

Further, the preferred method of distributing the apparatus 20 is to distribute the upper and lower bracketing components 24 and 22 with the end pieces as separate components. Of course, this is a preferred method and distribution and invention is not limited to such a component structure. For example, the locking surfaces 81 and 381 could be located directly on the outer elongate member 28 and 328 without departing from the scope the present invention.

Additionally, the engagement surfaces or locking surfaces 81, three 81, and 308 are adapted to receive the head portions 390 and 402 of the double threaded screws 384 and 386 are circular in the preferred embodiment. The invention is not limited to a circular engagement surface, but rather, a surface that allows passage of the shaft portion of the double threaded screw but frictionaly engages the head portion of the double headed screw is covered by the present invention.

While the invention is susceptible of various modifications and alternative forms, specific embodiments thereof have been shown by way of example in the drawings and will herein be described in detail. It s should be understood, however, that it is not intended to limit the invention to the particular forms disclosed, but, on the contrary, the intention is to cover all modifications, equivalents and alternatives falling within the spirit and scope of the invention as expressed in the appended claims.

I claim:

1. A retractable screen system adapted to be mounted to an opening defining structure, such as a doorway or window structure, where the opening defining structure comprises upper and lower structure members and first and second side structure members, said system comprising:

upper and lower bracketing members adapted to be mounted to said opening structure at upper and lower locations adjacent to said upper and lower structure members;

a generally vertically aligned screen retaining and dispensing assembly adapted to be mounted at a side mounting location adjacent to said first side structure member;

each of said bracketing members having a lateral axis and comprising:

a connecting portion by which the bracketing member can be connected to the opening defining structure;

a slideway portion defining a laterally aligned slideway;

said retaining and dispensing assembly comprising:

a screen housing;

a screen member having inner and outer vertically aligned screen edge portions and upper and lower horizontally aligned screen edge portions;

a dispensing and retracting mechanism mounted to said housing and having a rotatable portion connected to the screen inner edge portion, said dispensing and retracting mechanism being arranged to be able to retain the screen member in a rolled up retained position and enable the screen member to be extended from the retained position to its extended position;

said slideway portions of the upper and lower bracketing members being arranged to engage the upper and lower screen edge portions, respectively, in retaining engagement, and said slideways being aligned relative to the retaining and dispensing assembly so that the upper and lower screen edge portions can be extended and retracted from the retaining and dispensing assembly along the slideways of the upper and lower bracketing members to the extended position and then retracted from the extended position along the slideways to the retracted position;

said retaining and dispensing assembly comprising a screen housing connecting portion which is fixedly connected to said opening defining structure, and a detachable screen housing portion which is removably mounted to said screen housing connecting portion, whereby said detachable screen housing portion, along with the screen member and the dispensing and retracting mechanism, can be removed as a unit from the screen housing connecting portion, and also be reconnected to said screen housing connecting portion; and said detachable screen housing portion having first and second connecting regions, said first connecting region being adjacent to a location at which the screen member extends from the screen housing, and said second connecting region being said spaced laterally from said first connecting region, whereby said detachable screen housing portion can be mounted to the fixed connecting portion by first engaging the first connecting region to the fixed connecting portion to properly position the screen member, and then the second connecting region can be connected.

2. The system as recited in claim 1, wherein the outer edge portion of the screen member has at upper and lower locations connecting members to retain said screen member in its extended position, and the end connecting members of the upper and lower bracketing members having laterally extending connecting portions which are positioned so as to come into releasable connecting engagement with the connecting members on the screen member.

3. A retractable flexible screen system adapted to be fitted to an opening such as a door frame or window having a first lateral section, a second lateral section and an upper section, the retractable flexible screen system comprising:

a housing having an upper portion and a lower portion, the housing comprising;

a first connection portion located in the lower portion, a second connection portion having an engagement surface defining an open region that is adapted to engage a first threaded portion of an attachment screw where the second threaded portion is allowed to pass freely therethrough, a third connection portion located in the upper portion of the housing, an interior surface defining at least a partial interior chamber, a lower bracket having a laterally extending mounting region adapted to be rigidly mounted to the lower sill of the door frame, a surface defining a laterally extending slideway and a mounting region adapted to be mounted to the first connection portion of the housing, an inner surface defining a chamber;

an upper bracket having a connection portion adapted to be rigidly mounted to the upper portion of the door frame, a surface defining a laterally extending slideway, a mounting region adapted to be mounted to the third connection portion of the housing, an inner surface defining a chamber;

a retractable screen having an upper portion, a lower portion a connection portion and a lateral portion where a substantially vertical brace is attached to the lateral portion and the connection portion is attached to a substantially vertical roll that comprises a spring biasing system adapted to retract the retractable screen, the upper portion of the screen is adapted to extend in the chamber of the upper mounting bracket and the lower portion of the screen is adapted to extend in the chamber of the lower mounting bracket whereas the substantially vertical brace is adapted to be displaced laterally and the screen withdrawn from the housing.

4. The apparatus as recited in claim 3 wherein the lower mounting bracket having an outer casing rigidly attached to the laterally extending mounting region and having an interior surface adapted to house an inner elongate member having an exterior surface that at least partially defines a cylinder is adapted to rotate about the substantial lateral axis and has a surface defining the laterally extending slideway of the lower bracket.

5. The apparatus as recited in claim 4 where the lower mounting bracket further comprises:

an inner elongate member having an exterior surface that at least partially defines a cylinder and intimately engages the interior surface of the outer casing.

6. The apparatus as recited in claim 3 wherein the housing comprises a vertical brace and a screen dispenser where the vertical brace is fixedly attached to the molding of the door frame and the second member is adapted to the mounted to the vertical brace.

7. The apparatus as recited in claim 3 wherein the lower portion of the screen defines a plurality of buttons that extend in the transverse direction a distance that is greater than the transverse gap distance of the laterally extending slideway of the lower bracket.

8. The apparatus as recited in claim 7 wherein the buttons are adapted to pass with moderate resistance through the laterally extending slideway when excessive tension is applied to the screen.

9. The apparatus as recited in claim 3 wherein the upper bracket has a first connection portion located at a laterally opposed distance to the connection portion and has a surface that defines an opening with a central axis in the transverse direction.

10. The apparatus as recited in claim 9 wherein the upper bracket is mounted to the door frame with a dual thread connection screw having a threaded head portion and a threaded shaft portion when the threaded head portion has a mean diameter greater than the mean diameter of the threaded shaft portion, the threaded shaft portion is adapted to pass freely through the opening of the connection portion of the upper bracket.

11. A method of installing a retractable screen system at an opening such as a door or window having a molding with an upper portion, a lower still, and a lateral portion, said method comprising:

providing a lower bracketing component having a first mounting region and a laterally extending slideway and fastening it to the still of the door frame, providing a vertical brace having a first mounting region, a second mounting region, and an engagement surface defining an opening where the first mounting region of the vertical brace is engaged to the first mounting region of the lower bracketing component, the vertical brace aligned substantially vertically in an alignment position and a shaft portion of a double threaded screw passes through the said opening and the threaded head portion of the double headed screw engages the engagement surface of the vertical brace to hold the vertical brace in the alignment position, providing an upper bracketing component with a first mounting portion, a second engagement surface defining a second opening, and a second laterally extending slideway, where the first mounting portion of the upper bracketing component engages the second mounting region to the vertical brace, aligning the upper bracketing member in a bracketing plane and fastening the upper bracketing member to the upper portion of the opening by passing the shaft portion of a second double threaded screw through the said second opening where the threaded head portion engages the second engagement surface to hold the upper bracketing member in a bracketing plane, providing a screen dispenser and mounting it to the vertical brace in a manner so the handle portion of the screen dispenser extends in the laterally extending slideways of the upper and lower bracketing components.

12. A retractable screen system adapted to be mounted to an opening defining structure, such as a doorway or window structure, where the opening defining structure comprises upper and lower structure members and first and second side structure members, said system comprising:

upper and lower bracketing members adapted to be mounted to said opening structure at upper and lower locations adjacent to said upper and lower structure members;

a generally vertically aligned screen retaining and dispensing assembly adapted to be mounted at a side mounting location adjacent to said first side structure member;

each of said bracketing members having a lateral axis and comprising:

a connecting portion by which the bracketing member can be connected to the opening defining structure;

a slideway portion defining a laterally aligned slideway;

said retaining and dispensing assembly comprising:

a screen housing;

a screen member having inner and outer vertically aligned screen edge portions and upper and lower horizontally aligned screen edge portions;

a dispensing and retracting mechanism mounted to said housing and having a rotatable portion connected to the screen inner edge portion, said dispensing and retracting mechanism being arranged to be able to retain the screen member in a rolled up retained position and enable the screen member to be extended from the retained position to its extended position;

said slideway portions of the upper and lower bracketing members being arranged to engage the upper and lower screen edge portions, respectively, in retaining engagement, and said slideways being aligned relative to the retaining and dispensing assembly so that the upper and lower screen edge portions can be extended and retracted from the retaining and dispensing assembly along the slideways of the upper and lower bracketing members to the extended position and then retracted from the extended position along the slideways to the retracted position;

said retaining and dispensing assembly comprising a screen housing connecting portion which is fixedly connected to said opening defining structure, and a detachable screen housing portion which is removably mounted to said screen housing connecting portion, whereby said detachable screen housing portion, along with the screen member and the dispensing and retracting mechanism, can be removed as a unit from the screen housing connecting portion, and also be reconnected to said screen housing connecting portion; and said screen housing comprising upper and lower end caps, at which the first and second connecting regions are positioned, and by which connection is made to said dispensing and retracting mechanism.

13. A retractable screen system adapted to be mounted to an opening defining structure, such as a doorway or window structure, where the opening defining structure comprises upper and lower structure members and first and second side structure members, said system comprising:

upper and lower bracketing members adapted to be mounted to said opening structure at upper and lower locations adjacent to said upper and lower structure members;

a generally vertically aligned screen retaining and dispensing assembly adapted to be mounted at a side mounting location adjacent to said first side structure member;

each of said bracketing members having a lateral axis and comprising:

a connecting portion by which the bracketing member can be connected to the opening defining structure;

a slideway portion defining a laterally aligned slideway;

said retaining and dispensing assembly comprising:

a screen housing;

a screen member having inner and outer vertically aligned screen edge portions and upper and lower horizontally aligned screen edge portions;

a dispensing and retracting mechanism mounted to said housing and having a rotatable portion connected to the screen inner edge portion, said dispensing and retracting mechanism being arranged to be able to retain the screen member in a rolled up retained position and enable the screen member to be extended from the retained position to its extended position;

said slideway portions of the upper and lower bracketing members being arranged to engage the upper and lower screen edge portions, respectively, in retaining engagement, and said slideways being aligned relative to the retaining and dispensing assembly so that the upper and lower screen edge portions can be extended and retracted from the retaining and dispensing assembly along the slideways of the upper and lower bracketing members to the extended position and then retracted from the extended position along the slideways to the retracted position;

said dispensing and retracting mechanism comprising a retracting spring member having a first end connected to the rotatable portion of the dispensing and retracting mechanism, and having a second connecting end, which is connected to an adjusting member which can be rotatably moved to selected positions so as to either relax said spring member or create increased stress on said spring member so as to adjust a tension force on the screen member.

14. A retractable screen system adapted to be mounted to an opening defining structure, such as a doorway or window structure, where the opening defining structure comprises upper and lower structure members and first and second side structure members, said system comprising:

upper and lower bracketing members adapted to be mounted to said opening structure at upper and lower locations adjacent to said upper and lower structure members;

a generally vertically aligned screen retaining and dispensing assembly adapted to be mounted at a side mounting location adjacent to said first side structure member;

each of said bracketing members having a lateral axis and comprising:

a connecting portion by which the bracketing member can be connected to the opening defining structure;

a slideway portion defining a laterally aligned slideway;

said retaining and dispensing assembly comprising:

a screen housing;

a screen member having inner and outer vertically aligned screen edge portions and upper and lower horizontally aligned screen edge portions;

a dispensing and retracting mechanism mounted to said housing and having a rotatable portion connected to the screen inner edge portion, said dispensing and retracting mechanism being arranged to be able to retain the screen member in a rolled up retained position and enable the screen member to be extended from the retained position to its extended position;

said slideway portions of the upper and lower bracketing members being arranged to engage the upper and lower screen edge portions, respectively, in retaining engagement, and said slideways being aligned relative to the retaining and dispensing assembly so that the upper and lower screen edge portions can be extended and retracted from the retaining and dispensing assembly along the slideways of the upper and lower bracketing members to the extended position and then retracted from the extended position along the slideways to the retracted position;

said slideway portion of at least one of said bracketing members comprising a first base slideway portion connected to the connecting portion of its bracketing member, and a second adjustable slideway portion defining an elongate slot to receive its related screen edge portion, said second adjustable slideway portion being mounted to said first slideway portion for at least limited rotational movement so that said elongate slot of the second slideway portion can be properly positioned relative to the screen member.

15. The system as recited in claim 14, wherein said first base slideway portion extends along a substantial length of its related bracketing member, and defines an elongate chamber having a base slot which faces toward the an open region defined by the opening defining structure, and also defines an elongate chamber to receive said second adjustable slideway portion, the base slot of the first slideway portion having a lateral dimension greater than a lateral dimension of the elongate slot of the second adjustable slideway portion, whereby said second adjustable slideway portion can be moved to different angular positions for proper angular orientation, with the elongate slot opening of the second adjustable slideway portion not being obstructed by said base slideway.

16. The system as recited claim 15, wherein each slideway portion has an end connecting member which has a first engaging portion to engage the second slideway portion so as to limit relative rotational movement between the connecting member and the second slideway portion, and a second connecting portion making a connection with said first slideway portion in a manner to limit axial movement of the connecting member relative to the first slideway portion, whereby the second slideway portion is axially positioned within said first slideway portion and yet permitted at least limited rotational movement of said second slideway portion.

17. The system as recited in claim 16, wherein said connecting member has a protruding connecting portion which extends into an end of said first and second slideway portions so as to come into engagement with matching connecting portions of said first and second slideway portions.

18. A retractable screen system adapted to be mounted to an opening defining structure, such as a doorway or window structure, where the opening defining structure comprises upper and lower structure members and first and second side structure members, said system comprising:

upper and lower bracketing members adapted to be mounted to said opening structure at upper and lower locations adjacent to said upper and lower structure members;

a generally vertically aligned screen retaining and dispensing assembly adapted to be mounted at a side mounting location adjacent to said first side structure member;

each of said bracketing members having a lateral axis and comprising:

a connecting portion by which the bracketing member can be connected to the opening defining structure;

a slideway portion defining a laterally aligned slideway;

said retaining and dispensing assembly comprising:

a screen housing;

a screen member having inner and outer vertically aligned screen edge portions and upper and lower horizontally aligned screen edge portions;

a dispensing and retracting mechanism mounted to said housing and having a rotatable portion connected to the screen inner edge portion, said dispensing and retracting mechanism being arranged to be able to retain the screen member in a rolled up retained position and enable the screen member to be extended from the retained position to its extended position;

said slideway portions of the upper and lower bracketing members being arranged to engage the upper and lower screen edge portions, respectively, in retaining engagement, and said slideways being aligned relative to the retaining and dispensing assembly so that the upper and lower screen edge portions can be extended and retracted from the retaining and dispensing assembly along the slideways of the upper and lower bracketing members to the extended position and then retracted from the extended position along the slideways to the retracted position;

each slideway portion of the first and second bracketing members defining a related elongate slot of a first width dimension, and having a slideway chamber communicating with said slot and having a lateral dimension greater than the width dimension of its related slot, each of the upper and lower edge portions of the screen having connected thereto spaced connecting members having a thickness dimension greater that the first width dimension of its related slot, but able to be positioned within the related slot chamber, whereby with the connecting members being positioned within the slot chamber and the screen member extending through the slot, the edge portions of the screen are retained in the upper and lower slideways.

19. The system as recited in claim 18, wherein each of said connecting members has a first connecting portion of a first hardness level, and a second laterally yielding connecting portion, and a width dimension of the connecting member at the location of the yielding portion is greater than the width dimension of its related slot, said connecting portions being arranged so that with a force being imposed on said screen member so as to tend to pull the screen edge portion out of its related slot, the yielding portion of the connecting member is able to be compressed to permit the connecting member to move through the slot, whereby a problem of impacts on the screen member causing damage to the screen member is at least alleviated by said connecting portions being released upon encountering the impact force.

20. The system as recited in claim 19, wherein each of said connecting members comprises, prior to being connected to its related screen member a plurality of connecting fingers extending outwardly from the connecting member, with said fingers providing connections by said connecting fingers being deformed from their original extending position to make a connection through the screen member.

21. The system as recited in claim 20, wherein said the connecting fingers of the connecting members are made of thermally deformable material, whereby after said connecting members are positioned relative to the screen member so that the fingers extend through the screen member, heat can be applied to said fingers to cause deformation of said fingers and connection to said screen member.

22. A retractable screen system adapted to be mounted to an opening defining structure, such as a doorway or window structure, where the opening defining structure comprises upper and lower structure members and first and second side structure members, said system comprising:

upper and lower bracketing members adapted to be mounted to said opening structure at upper and lower locations adjacent to said upper and lower structure members;

a generally vertically aligned screen retaining and dispensing assembly adapted to be mounted at a side mounting location adjacent to said first side structure member;

each of said bracketing members having a lateral axis and comprising:

a connecting portion by which the bracketing member can be connected to the opening defining structure;

a slideway portion defining a laterally aligned slideway;

said retaining and dispensing assembly comprising:

a screen housing;

a screen member having inner and outer vertically aligned screen edge portions and upper and lower horizontally aligned screen edge portions;

a dispensing and retracting mechanism mounted to said housing and having a rotatable portion connected to the screen inner edge portion, said dispensing and retracting mechanism being arranged to be able to retain the screen member in a rolled up retained position and enable the screen member to be extended from the retained position to its extended position;

said slideway portions of the upper and lower bracketing members being arranged to engage the upper and lower screen edge portions, respectively, in retaining engagement, and said slideways being aligned relative to the retaining and dispensing assembly so that the upper and lower screen edge portions can be extended and retracted from the retaining and dispensing assembly along the slideways of the upper and lower bracketing members to the extended position and then retracted from the extended position along the slideways to the retracted position;

least one of said upper bracketing member, lower bracketing member and said screen housing having a mounting portion which provides for connection to said opening defining structure, said system further comprising one or more connectors adapted to connect the mounting portion to the opening defining structure in a manner so that the mounting portion could have one or more portions thereof spaced from said opening defining structure so as to properly align the mounting structure, said connector comprising a screw member having a head and a shank, with said shank having an outer end threaded portion of a smaller diameter further from said head and an inner threaded shank portion of a greater diameter positioned closer to said head, said screw member being positioned so that the outer threaded end portion is threaded into engagement with said opening defining structure to a predetermined depth, and the inner larger diameter threaded portion is engaged with the mounting structure at a location on the threaded member so that the mounting member is properly positioned, whereby proper angular alignment can be obtained, and the system of the present invention is able to be mounted to an opening defining structure having various alignments and surface arrangement thereon.

23. The system as recited in claim 22, wherein there is a plurality of such connecting members connecting the mounting structure to the opening defining structure.

* * * * *